US009352923B2

(12) United States Patent
Cornell et al.

(10) Patent No.: US 9,352,923 B2
(45) Date of Patent: May 31, 2016

(54) AIR SHOE WITH ROLLER PROVIDING LATERAL CONSTRAINT

(71) Applicants: David James Cornell, Scottsville, NY (US); Christopher M. Muir, Rochester, NY (US); Randy Eugene Armbruster, Rochester, NY (US)

(72) Inventors: David James Cornell, Scottsville, NY (US); Christopher M. Muir, Rochester, NY (US); Randy Eugene Armbruster, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 204 days.

(21) Appl. No.: 14/190,146

(22) Filed: Feb. 26, 2014

(65) Prior Publication Data

US 2015/0239699 A1 Aug. 27, 2015

(51) Int. Cl.
*B65H 23/24* (2006.01)
*B41J 15/04* (2006.01)

(52) U.S. Cl.
CPC ..... *B65H 23/24* (2013.01); *B41J 15/046* (2013.01); *B65H 2406/111* (2013.01); *B65H 2406/14* (2013.01)

(58) Field of Classification Search
CPC ..... B65H 20/10; B65H 20/12; B65H 23/24; B65H 2406/111; B65H 2406/14; B65H 20/14; B41J 15/046
See application file for complete search history.

(56) References Cited

U.S. PATENT DOCUMENTS

| | | | | |
|---|---|---|---|---|
| 3,342,481 | A | 9/1967 | Kaplan | |
| 3,405,855 | A | 10/1968 | Daly et al. | |
| 3,567,093 | A | 3/1971 | Johnson | |
| 4,165,132 | A | 8/1979 | Hassan | |
| 4,187,867 | A * | 2/1980 | Sherman | B65H 23/24 118/419 |
| 4,231,272 | A | 11/1980 | Crouse | |
| 4,322,026 | A | 3/1982 | Young, Jr. | |
| 4,542,842 | A | 9/1985 | Reba | |
| 5,036,737 | A | 8/1991 | Glaser | |
| 5,246,155 | A | 9/1993 | Barrois | |
| 5,979,731 | A | 11/1999 | Long et al. | |
| 6,003,988 | A | 12/1999 | McCann et al. | |
| 6,125,754 | A * | 10/2000 | Harris | B41F 13/02 101/420 |
| 6,305,771 | B1 | 10/2001 | Jang | |
| 6,427,941 | B1 | 8/2002 | Hikita | |

(Continued)

FOREIGN PATENT DOCUMENTS

| | | | |
|---|---|---|---|
| DE | 10 2004 003 899 | 9/2004 | |
| DE | 102006027529 A1 * | 12/2007 | B65H 23/24 |

(Continued)

OTHER PUBLICATIONS

Machine translation of DE 102006027529, retrieved Nov. 13, 2015.*

*Primary Examiner* — Michael McCullough
(74) *Attorney, Agent, or Firm* — Kevin E. Spaulding

(57) ABSTRACT

A web-guiding system for guiding a web of media along a transport path including a web-guiding roller located in proximity to a fixed web-guiding structure having a pattern of air holes formed through its exterior surface. The web of media travels around the web-guiding roller with the web of media contacting the web-guiding roller through a wrap angle of less than 5 degrees, and travels around the fixed web-guiding structure through a wrap angle of more than 10 degrees. An air source provides an air flow through the air holes formed lifting the web of media away from the web-guiding structure such that the web of media is substantially not in contact with the web-guiding structure.

23 Claims, 22 Drawing Sheets

(56) References Cited

U.S. PATENT DOCUMENTS

| | | | | |
|---|---|---|---|---|
| 7,311,234 | B2 * | 12/2007 | Solberg | B65H 23/24 226/193 |
| 8,303,106 | B2 | 11/2012 | Kasiske et al. | |
| 8,936,243 | B1 | 1/2015 | Muir et al. | |
| 2003/0049042 | A1 | 3/2003 | Bogoshian | |
| 2005/0098680 | A1 | 5/2005 | Naruoka et al. | |
| 2010/0266766 | A1 | 10/2010 | Hein et al. | |
| 2011/0135405 | A1 | 6/2011 | Miyaji et al. | |
| 2011/0278390 | A1 * | 11/2011 | Armbruster | B41J 3/60 242/615.21 |
| 2013/0341858 | A1 | 12/2013 | Herrmann | |

FOREIGN PATENT DOCUMENTS

| | | | |
|---|---|---|---|
| FR | 1 218 472 | | 5/1960 |
| WO | 2004-74148 | A2 | 9/2004 |

* cited by examiner

AIR SHOE WITH ROLLER PROVIDING LATERAL CONSTRAINT

CROSS REFERENCE TO RELATED APPLICATIONS

Reference is made to commonly assigned, U.S. patent application Ser. No. 14/016,427 (now U.S. Publication No. 2015/0060511), entitled "Positive pressure web wrinkle reduction system," by Kasiske Jr., et al.; to commonly assigned U.S. patent application Ser. No. 14/190,125 (now U.S. Pat. No. 9,120,634), entitled "Media guiding system using Bernoulli force roller," by Muir et al.; to commonly assigned U.S. patent application Ser. No. 14/190,127 (now U.S. Pat. No. 9,079,736), entitled "Wrinkle reduction system using Bernoulli force rollers," by Muir et al.; to commonly assigned U.S. patent application Ser. No. 14/190,137 (now U.S. Pat. No. 8,936,243), entitled "Media diverter system using Bernoulli force rollers," by Muir et al.; and to commonly assigned U.S. patent application Ser. No. 14/190,153 (now U.S. Publication No. 2015/0239700), entitled "Air shoe with integrated roller," by Cornell et al., each of which is incorporated herein by reference.

FIELD OF THE INVENTION

This invention pertains to the field of media transport and more particularly to an apparatus for reducing wrinkles while guiding a receiver media web.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink) is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction, within the plane of the un-deformed receiver media 3, is commonly referred to as the cross-track direction 7. Typically, as the receiver media 3 expands in the cross-track direction 7, contact between the receiver media 3 and contact surface 8 of rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

U.S. Pat. No. 3,405,855 to Daly et al., entitled "Paper guide and drive roll assemblies," discloses a web guiding apparatus having peripheral venting grooves to vent air carried by the underside of the traveling web.

U.S. Pat. No. 4,322,026 to Young, Jr., entitled "Method and apparatus for controlling a moving web," discloses a method for smoothing and guiding a web in which the web is moved in an upward direction past pressurized fluid discharge manifolds on either side of the web. The manifolds direct continuous streams of pressurized fluid, such as air, outwardly toward the side edges of the web to smooth wrinkles in the web. Additional manifolds are used to intermittently direct streams of fluid to laterally move and guide the web.

U.S. Pat. No. 4,542,842 to Reba, entitled "Pneumatic conveying method for flexible webs," discloses a method for conveying a web using inner and outer pairs of side jet nozzles employing the Coanda effect to propel the web while preventing undue distortion.

U.S. Pat. No. 5,979,731 to Long et al., entitled "Method and apparatus for preventing creases in thin webs," discloses an apparatus for removing longitudinal wrinkles from a thin moving web of media. The media is wrapped around a perforated cylindrical air bar disposed in proximity to a contact roller.

U.S. Pat. No. 6,427,941 to Hikita, entitled "Web transporting method and apparatus," discloses a web transporting apparatus that transports a web by floating the web on air jetted from holes formed in a roller while the edges of the web are supported by edge rollers.

There remains a need for a means to prevent the formation of receiver media wrinkles as a receiver media contacts web-guiding structures in a digital printing system.

SUMMARY OF THE INVENTION

The present invention represents a web-guiding system for guiding a web of media travelling from upstream to downstream along a transport path in an in-track direction, the web of media having a first side and an opposing second side, comprising:

a fixed web-guiding structure having a convex exterior surface, wherein a pattern of air holes are formed through the exterior surface;

an air source for providing an air flow through the air holes; and a web-guiding roller located in proximity to the web-guiding structure, the web-guiding roller being rotatable around a roller axis;

wherein the web of media travels around the web-guiding roller with the web of media contacting an exterior surface of the web-guiding roller through a wrap angle of less than 5 degrees, and wherein the web of media travels around the fixed web-guiding structure through a wrap angle of more than 10 degrees, the air flow through the air holes lifting the web of media away from the web-guiding structure such that the first side of the web of media is substantially not in contact with the web-guiding structure.

This invention has the advantage that the web of media can be redirected around the fixed web-guiding structure by a large wrap angle without forming wrinkles in the web of media.

It has the additional advantage that the web-guiding roller provides a lateral constraint to prevent the web of media from drifting laterally. The small wrap angle associated with the web-guiding roller prevents the formation of wrinkles as the web of media passes over the web-guiding roller.

DETAILED DESCRIPTION OF THE INVENTION

Figure 1:
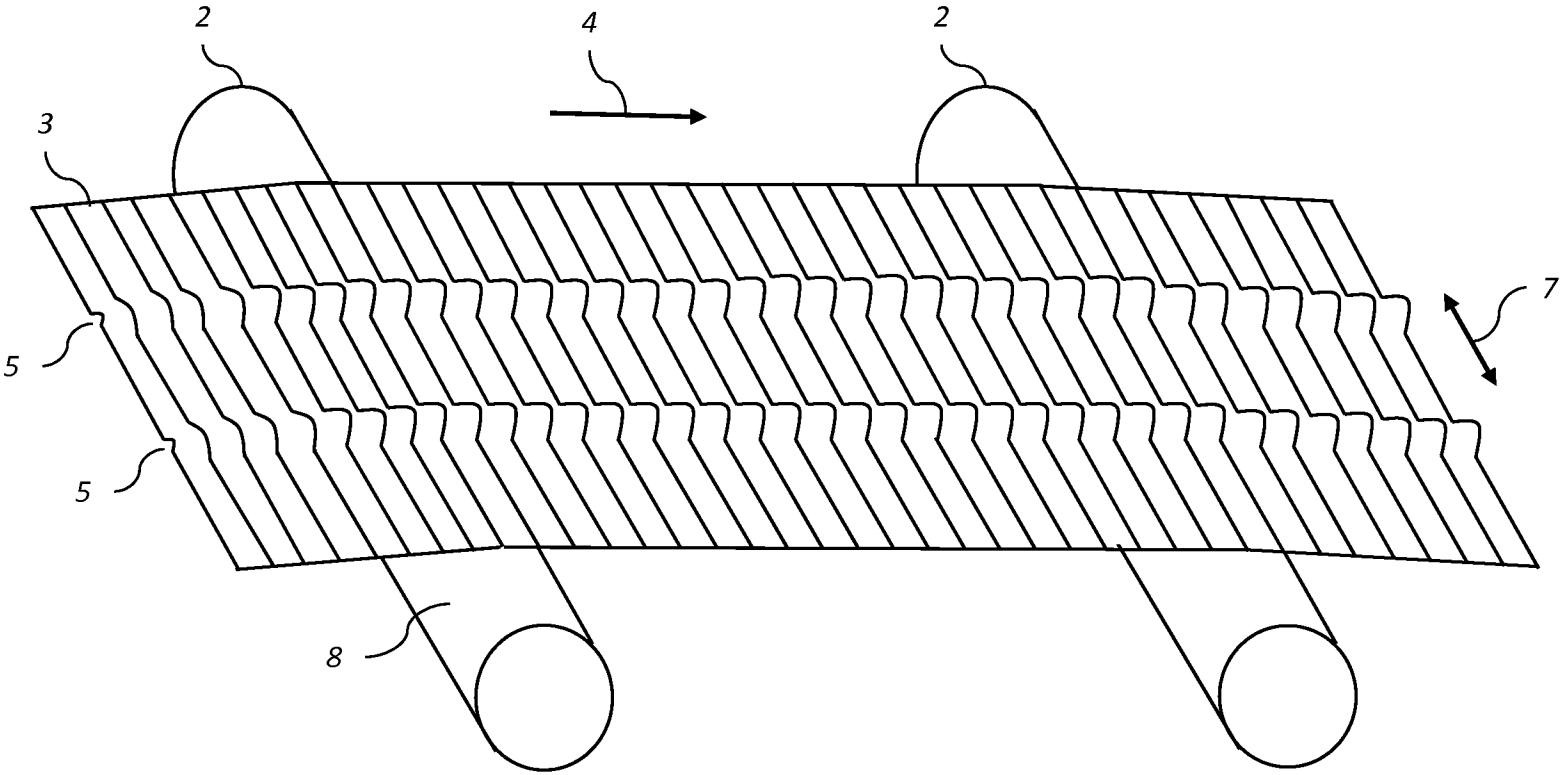
FIG. 1 (Prior Art)
FIG. 1 illustrates the formation of flutes in a continuous web of receiver media due to cross-track expansion of the receiver media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and may not be to scale for the sake of clarity. One of ordinary skill in the art will be able to readily determine the specific size and interconnections of the elements of the example embodiments of the present invention.

As described herein, the exemplary embodiments of the present invention provide receiver media guiding components useful for guiding the receiver media in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a receiver media. Typically, one of two types of ink jetting mechanisms is used, and is categorized by technology as either drop-on-demand inkjet printing or continuous inkjet printing.

Drop-on-demand inkjet printing provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal inkjet." A second commonly practiced drop-on-demand inkjet type uses piezoelectric actuators to change the volume of an ink chamber to eject an ink drop.

The second technology commonly referred to as "continuous" inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become printing drops and non-printing drops. Printing occurs by selectively deflecting either the printing drops or the non-printing drops and catching the non-printing drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of cut sheets. The continuous web of receiver media refers to a continuous strip of receiver media, generally originating from a source roll. The continuous web of receiver media is moved relative to the inkjet printing system components using a web transport system, which typically include drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies that print on continuous webs of receiver media. As such, the term "printhead" as used herein is intended to be generic and not specific to either technology. Additionally, the invention described herein is also applicable to other types of printing systems, such as offset printing and electrophotographic printing, that print on continuous webs of receiver media.

The terms "upstream" and "downstream" are terms of art referring to relative positions along the transport path of the receiver media; points on the receiver media move along the transport path from upstream to downstream.

Figure 2:
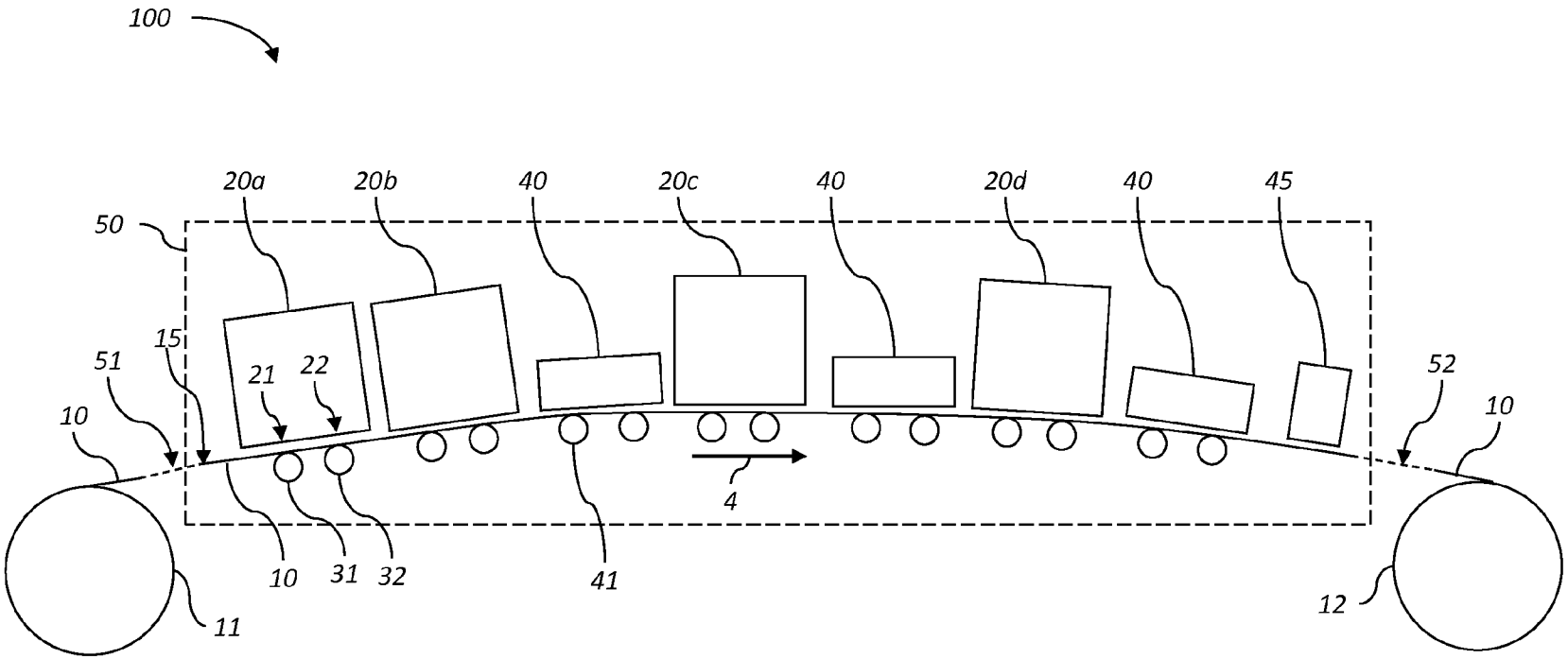
FIG. 2 is a simplified side view of an inkjet printing system.

Referring to FIG. 2, there is shown a simplified side view of a portion of a digital printing system 100 for printing on a first side 15 of a continuous web of receiver media 10. The printing system 100 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink.

Below each printhead 20*a*, 20*b*, 20*c*, 20*d* is a media guide assembly including print line rollers 31 and 32 that guide the continuous web of receiver media 10 past a first print line 21 and a second print line 22 as the receiver media 10 is advanced along a media path in the in-track direction 4. Below each dryer 40 is at least one dryer roller 41 for controlling the position of the web of receiver media 10 near the dryers 40.

Receiver media 10 originates from a source roll 11 of unprinted receiver media 10, and printed receiver media 10 is wound onto a take-up roll 12. Other details of the printing module 50 and the printing system 100 are not shown in FIG. 2 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 3:
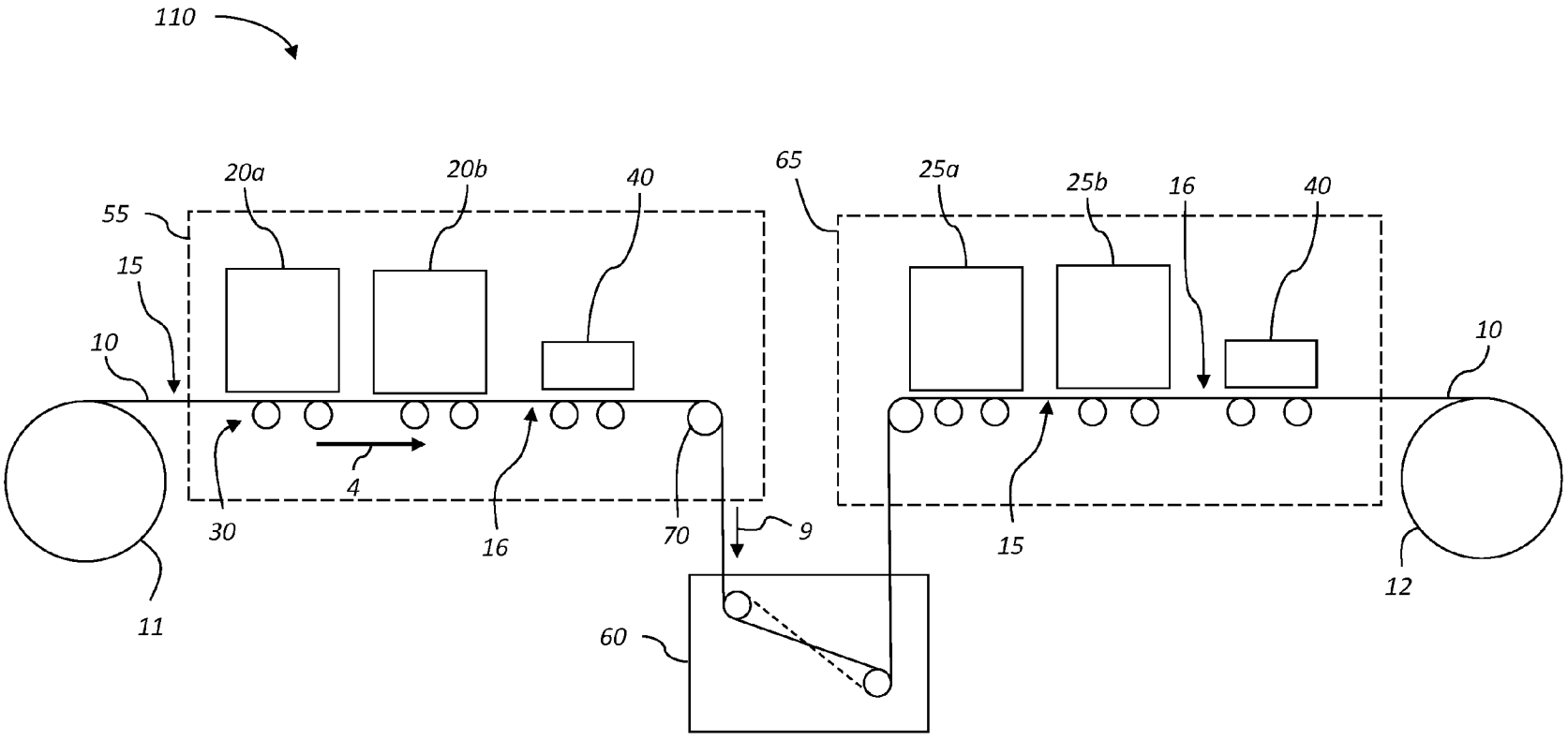
FIG. 3 is a simplified side view of an inkjet printing system for printing on both sides of a web of receiver media.

Referring to FIG. 3, there is shown a simplified side view of a portion of a printing system 110 for printing on both a first side 15 and a second side 16 of a continuous web of receiver media 10. Printing system 110 includes a first printing module 55, for printing on a first side 15 of the continuous web, having two printheads 20*a*, 20*b* and a dryer 40; a turnover mechanism 60; and a second printing module 65, for printing on the second side of the continuous web, having two printheads 25*a* and 25*b* and a dryer 40. A web-guiding system 30 guides the web of receiver media 10 from upstream to downstream along a transport path in an in-track direction 4 past through the first printing module 55 and the second printing module 65. The web-guiding system 30 includes rollers aligned with the print lines of the printheads 20*a*, 20*b*, 25*a*, and 25*b*. These rollers maintain the receiver media 10 at a fixed spacing from the printing modules to ensure a consistent time of flight for the print drops emitted by the printheads. The web-guiding system 30 also includes a web-guiding structure 70, which can be a roller for example, positioned near the exit of first printing module 55 for redirecting a direction of travel of the web of receiver media 10 along exit direction 9 in order to guide web of receiver media 10 toward the turnover mechanism 60. The movement of the receiver media of the guiding rollers of the web guide system also maintains the cross-track position of the continuous web provided there is sufficient traction between the continuous web and the guiding rollers.

It is not uncommon for a web-guiding system 30 to include a web-guiding structure that provides a large angular change in the direction of travel of the web of the receiver media 10. Such large angular changes may be required by geometric constraints on the overall dimensions of the web-guiding system 30 or the need to align the web of receiver media 10 with a downstream portion of the web-guiding system 30. For example, web-guiding structure 70, which is positioned near the exit of first printing module 55, redirects the direction of travel of the web of receiver media 10 by about 90° into exit direction 9 in order to guide web of receiver media 10 toward the turnover mechanism 60.

When the receiver media 10 is a hygroexpansive material such as cellulose based paper, and at least portions of the receiver media 10 are moistened such as by inkjet printing, the receiver media can be prone to wrinkling when wrapped at high wrap angles around a roller. A similar tendency to wrinkle exists at high wrap angle rollers when a very thin receiver media, such as plastic films of polyethylene and poly(ethylene terephthalate), is being transported along the transport path by the web-guiding system 30, as such receiver media 10 lack the compressive strength to flatten the ripples produced in the receiver media 10 by the variations in the in-track and cross-track tension.

Figure 4A:
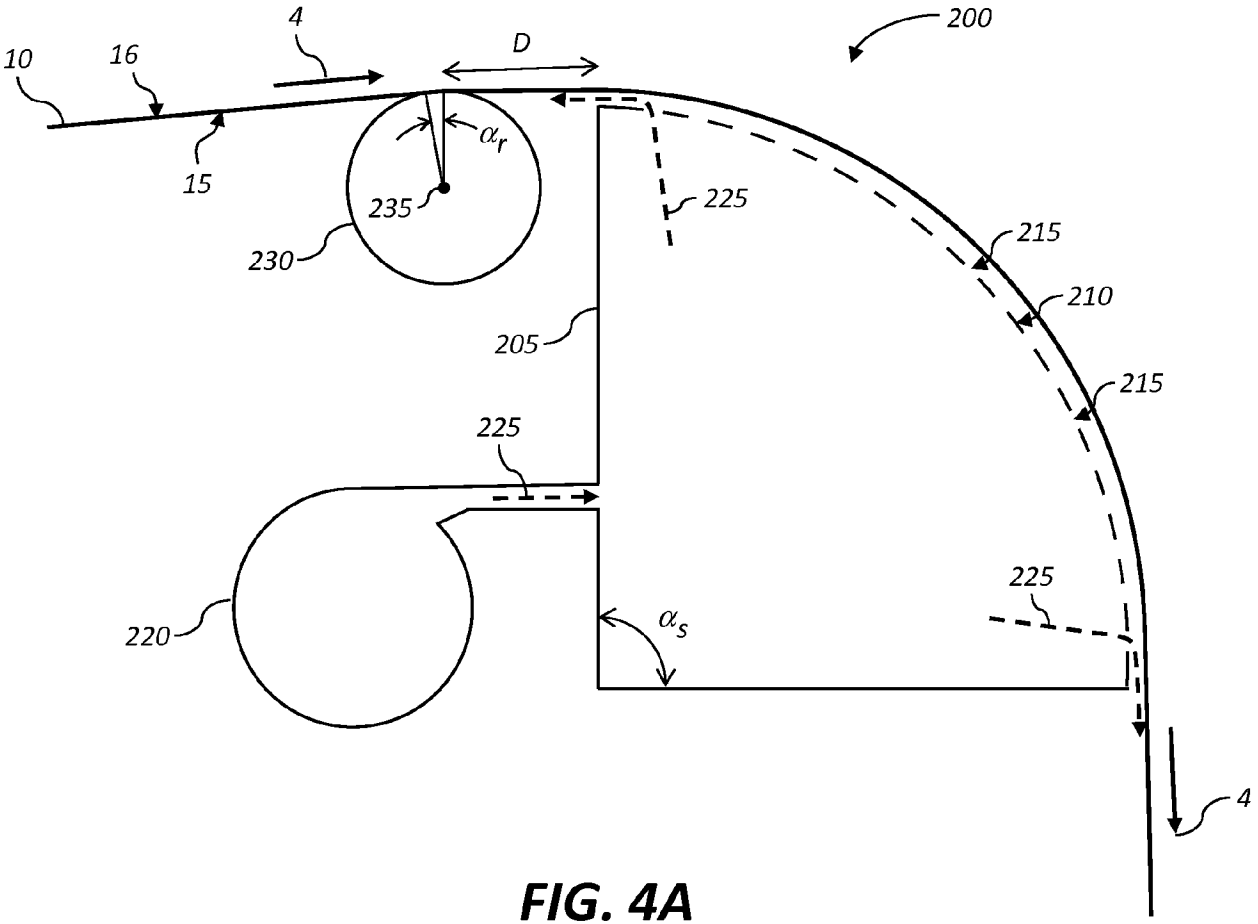
FIGS. 4A and 4B show schematic side-view diagrams illustrating web-guiding systems including a fixed web-guiding structure and a web-guiding roller in accordance with embodiments of the present invention.

FIG. 4A shows an embodiment of a web-guiding system 200 that overcomes the shortcomings of prior art systems, allowing for high angular changes in the receiver media 10 without inducing the formation of wrinkles. The web-guiding system 200 includes a fixed web-guiding structure 205 having a convex exterior surface 210. The web-guiding structure is fixed in the sense that it doesn't rotate or move with a surface speed that corresponds to the surface speed of the web of receiver media. The fixed web-guiding structure 205 being "fixed" is not intended to indicate that orientation of the fixed web-guiding structure 205 cannot be adjusted, either actively or passively, to align the fixed web-guiding structure 205 relative to the transport path of the receiver media 10. In the illustrated embodiment first side 15 of the receiver media 10 faces the exterior surface 210 of the fixed web-guiding structure 205, while second side 16 faces away from the fixed web-guiding structure 205.

A pattern of air holes 215 is formed through the exterior surface 210 of the fixed web-guiding structure 205, through which air 225 supplied by an air source 220 can flow. As the web of receiver media 10 travels around the fixed web-guiding structure 205, the flow of air 225 through the air holes 215 serves as an air bearing lifting the web of receiver media 10 away from the fixed web-guiding structure 205 such that first side 15 of the web of receiver media 10 is substantially not in contact with the fixed web-guiding structure 205. Within the context of the present disclosure, "substantially not in contact" means that the receiver media 10 contacts less than 5% of the exterior surface 210 of the fixed web-guiding structure 205 that is adjacent to the receiver media 10. (The fixed web-guiding structure 205 is sometimes referred to in the art as an "air shoe" or an "air bearing structure.")

As the web of receiver media 10 is supported by the air 225 so that there is minimal contact between the receiver media 10 and the exterior surface 210 of the fixed web-guiding structure 205, the receiver media 10 has minimal friction with the fixed web-guiding structure 205. As a result, the receiver media 10 can pass over the fixed web-guiding structure 205 without scuffing the receiver media 10. Furthermore, the transverse bending of the web of receiver media 10 as it goes around the fixed web-guiding structure 205 tends to flatten the web of receiver media 10. The lack of angular constraint on the receiver media 10 allows the receiver media 10 to spread laterally to enable the flattening of the web. The fixed web-guiding structure 205 can therefore accommodate large wrap angles $\alpha_s$ of the receiver media 10 without wrinkling. In the illustrated embodiment, the wrap angle $\alpha_s$ is approximately 90 degrees. Generally, the wrap angle $\alpha_s$ around the fixed web-guiding structure 205 will be more than about 10 degrees, and it may be as large as 180 degrees or more.

Because the receiver media 10 has minimal friction with the fixed web-guiding structure 205, it provides little or no lateral constraint to impede the lateral (i.e., cross-track) movement of the web of receiver media 10. Therefore, while the low friction is beneficial for inhibiting the formation of wrinkles, it has the detrimental effect of allowing the print media to drift in the cross-track direction 7 (FIG. 1). To compensate for this, the web-guiding system 200 also includes a web-guiding roller 230 having a roller axis 235 located along the media path in proximity to the fixed web-guiding structure 205. The web-guiding roller 230 provides a lateral constraint on the receiver media 10 when it is placed in close proximity to the fixed web-guiding structure 205 to inhibit cross-track drift or wander of the receiver media 10. Within the context of the present disclosure, the term "in proximity" should be taken to mean that the distance D that the receiver media 10 travels along the transport path between the web-guiding roller 230 and the fixed web-guiding structure 205 is less than either two diameters of the web-guiding roller 230 or 10% of the cross-track width of the receiver media 10, whichever is larger.

In a preferred embodiment, the web-guiding roller 230 is located on the same side of the web of receiver media 10 as the fixed web-guiding structure 205 as illustrated in FIG. 4A so that the receiver media 10 wraps around both elements in the same wrap direction (e.g., clockwise in FIG. 4A). In alternate embodiments (not shown) the web-guiding roller 230 can be located on the opposite side of the web of receiver media 10 as the fixed web-guiding structure 205. This alternate placement of the web-guiding roller 230 may be preferred in applications where a just printed side of the receiver media 10 is facing toward the fixed web-guiding structure 205. Placement of the web-guiding roller 230 on the opposite side of the receiver media 10 can reduce the risk of smearing or offsetting non-cured ink through contact with the web-guiding roller 230. The air bearing nature of the fixed web-guiding structure 205 prevents the smearing or offsetting non-cured ink as the receiver media 10 travels over the fixed web-guiding structure 230.

Figure 4B:
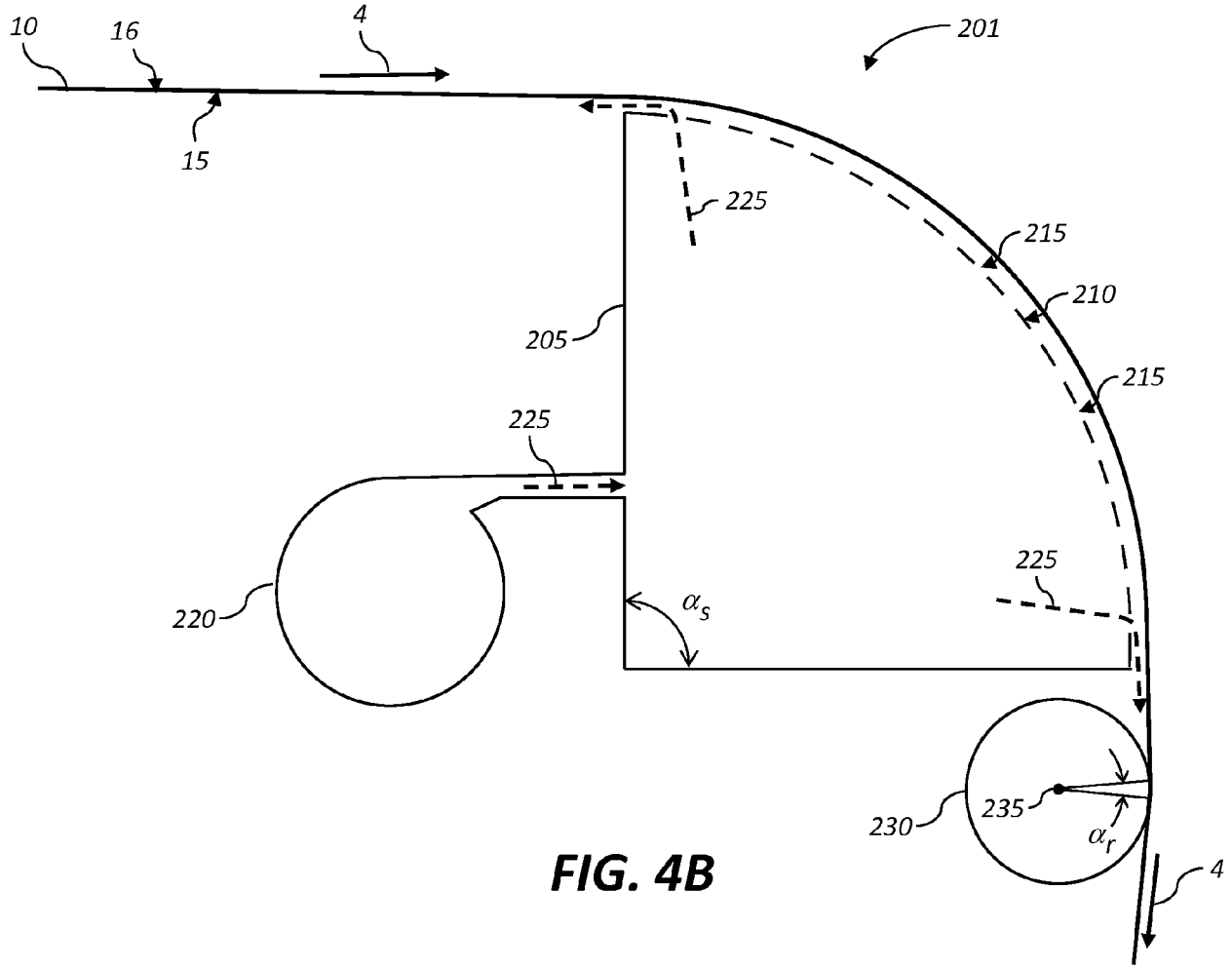

In a preferred embodiment, the web-guiding roller 230 is located immediately upstream of the fixed web-guiding structure 205 as is shown in FIG. 4A, but placement of the web-guiding roller 230 immediately downstream of the fixed web-guiding structure 205 as shown in the web-guiding system 201 of FIG. 4B is also effective for inhibiting cross-track drift or wander of the receiver media 10. As the web-guiding roller 230 provides an angular constraint in addition to the lateral constraint, the placement of the web-guiding roller 230 immediately upstream of the fixed web-guiding structure 205 has the advantage that it reduces any lateral shifts in the receiver media 10 that might be produced by an angular drift of the web at the entrance to the fixed web-guiding structure 205.

As is taught in commonly-assigned U.S. Pat. No. 6,003,988 to McCann et al., entitled "Printer architecture," which is incorporated herein by reference, the formation of creases or wrinkles in a web of media traveling through an inkjet printing system can be inhibited by limiting the wrap of the receiver media around rollers to small wrap angles. Therefore, to avoid the formation of wrinkles in the web-guiding system 200 of the present invention, the wrap angle $\alpha_r$ of the receiver media 10 around the web-guiding roller 230 is preferably less than about five degrees.

Figure 5:
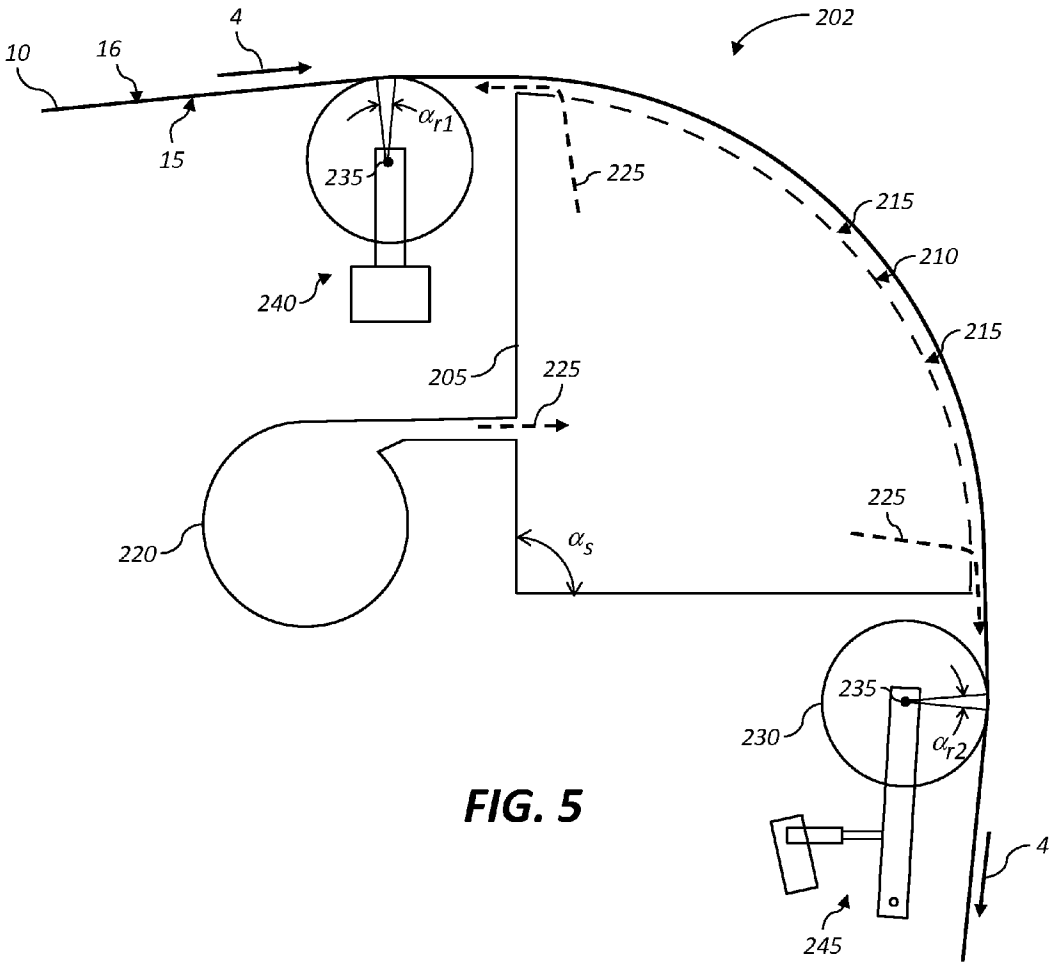
FIG. 5 shows a schematic side-view diagram illustrating a web-guiding system which includes a fixed web-guiding structure and two web-guiding rollers in accordance with an alternate embodiment.
Figure 6:
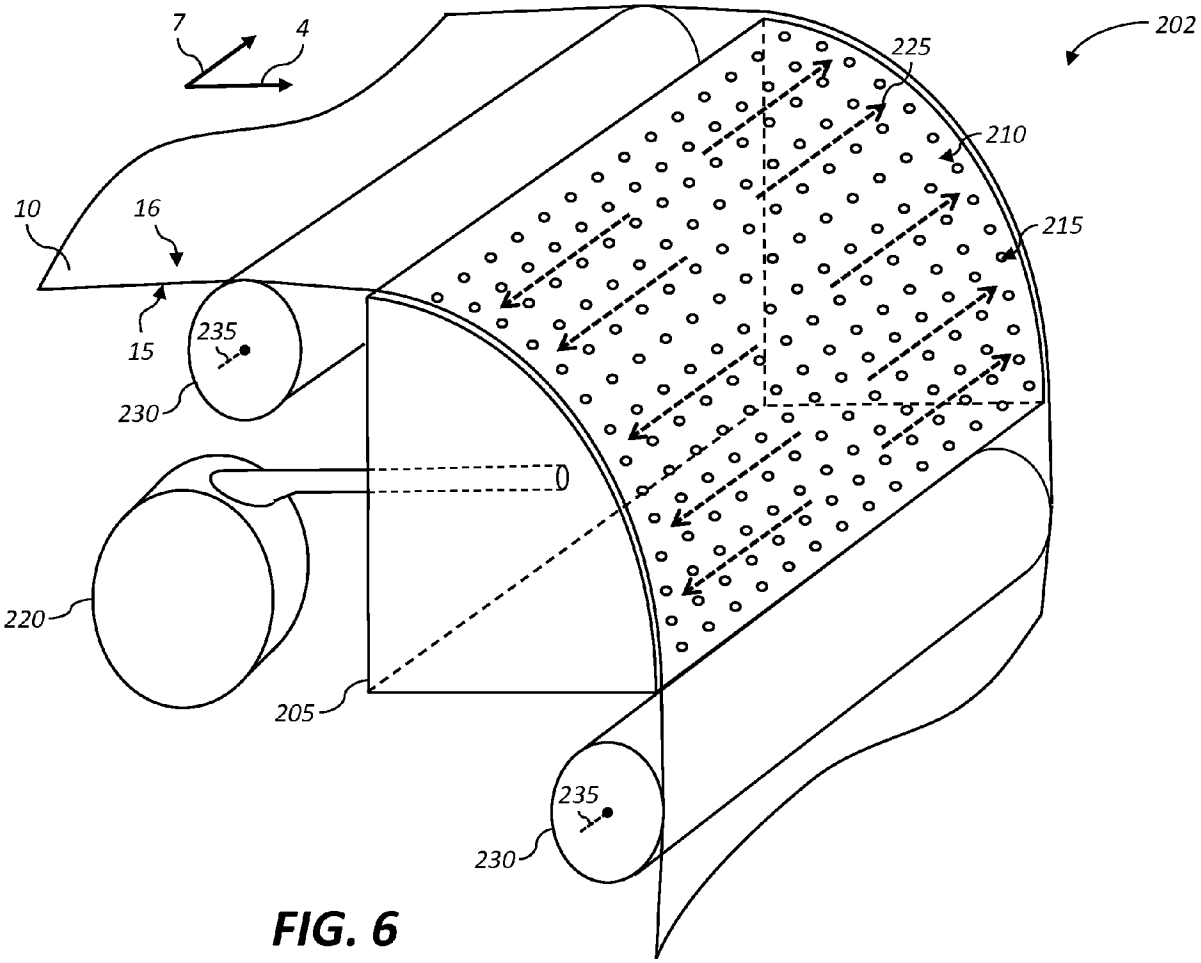
FIG. 6 is a perspective drawing showing the web-guiding system of FIG. 5.

FIGS. 5 and 6 show an alternate embodiment of a web-guiding system 202 in which there are two web-guiding rollers 230, one immediately upstream and one immediately downstream of the fixed web-guiding structure 205. The addition of the second web-guiding roller 230 immediately downstream of the fixed web-guiding structure 205 further enhances the cross-track stability of the web of receiver media 10. By limiting the wrap angle around the upstream web-guiding roller 230 ($\alpha_{r1}$) and the wrap angle around the downstream web-guiding roller 230 ($\alpha_{r2}$) of this embodiment to small wrap angles, such as less than about 5 degrees, the formation of creases or wrinkles around these web-guiding rollers 230 is inhibited.

The exemplary embodiment of FIG. 6 shows the air holes 215 as being circular in shape; however, this is not a requirement. In other embodiments, the air holes 215 can have other shapes such as ellipses, squares, rectangles or extended slits. In this example, the pattern of air holes 215 takes the form of a regular grid of air holes 215 having a fixed spacings in the cross-track direction 7 and the in-track direction 4. In other embodiments, the air holes 215 can be arranged in other patterns such as hexagonal grids, or can have non-uniform spacings. For example, in some embodiments it may be useful to space the air holes 215 non-uniformly so as to provide a substantially constant lifting force across the exterior surface 210 of the fixed web-guiding structure 205. Those skilled in the art will understand that fluid dynamics modeling can be used to determine an optimized pattern of spacings between the air holes 215 to provide the constant lifting force.

In some embodiments, the web-guiding system can also include a tensioning mechanism to provide a force on the web-guiding roller 230 to push it toward and into contact with the web of receiver media 10. The tensioning mechanism can take many different forms such as coil springs, leaf springs, torsion springs, flexure arms, air cylinders, and electro-mechanical actuators. In FIG. 5, a tensioning mechanism 240 associated with the upstream web-guiding roller 230 provides straight line motion of the web-guiding roller 230, while a tensioning mechanism 245 associated with the downstream web-guiding roller 230 includes a pivot arm support for the web-guiding roller 230, through which the force is applied to the web-guiding roller 230 by the tensioning mechanism 245. To ensure consistent tracking of the web of receiver media 10, the roller axis 235 of the web-guiding rollers 230 must remain substantially perpendicular to the direction of media travel (i.e., in-track direction 4) at the location along the transport path where the web of receiver media 10 contacts the web-guiding rollers.

In some embodiments, a roller control mechanism (not shown) is provided for adjusting an orientation of the roller axis 235 relative to the in-track direction 4. This can be used to provide a steering force on the web of receiver media 10. The roller control mechanism can include a media edge sensor (not shown) which detects a position of the receiver media 10 and adjusts the roller axis 235 to compensate for any drift from a nominal position.

Figure 7:
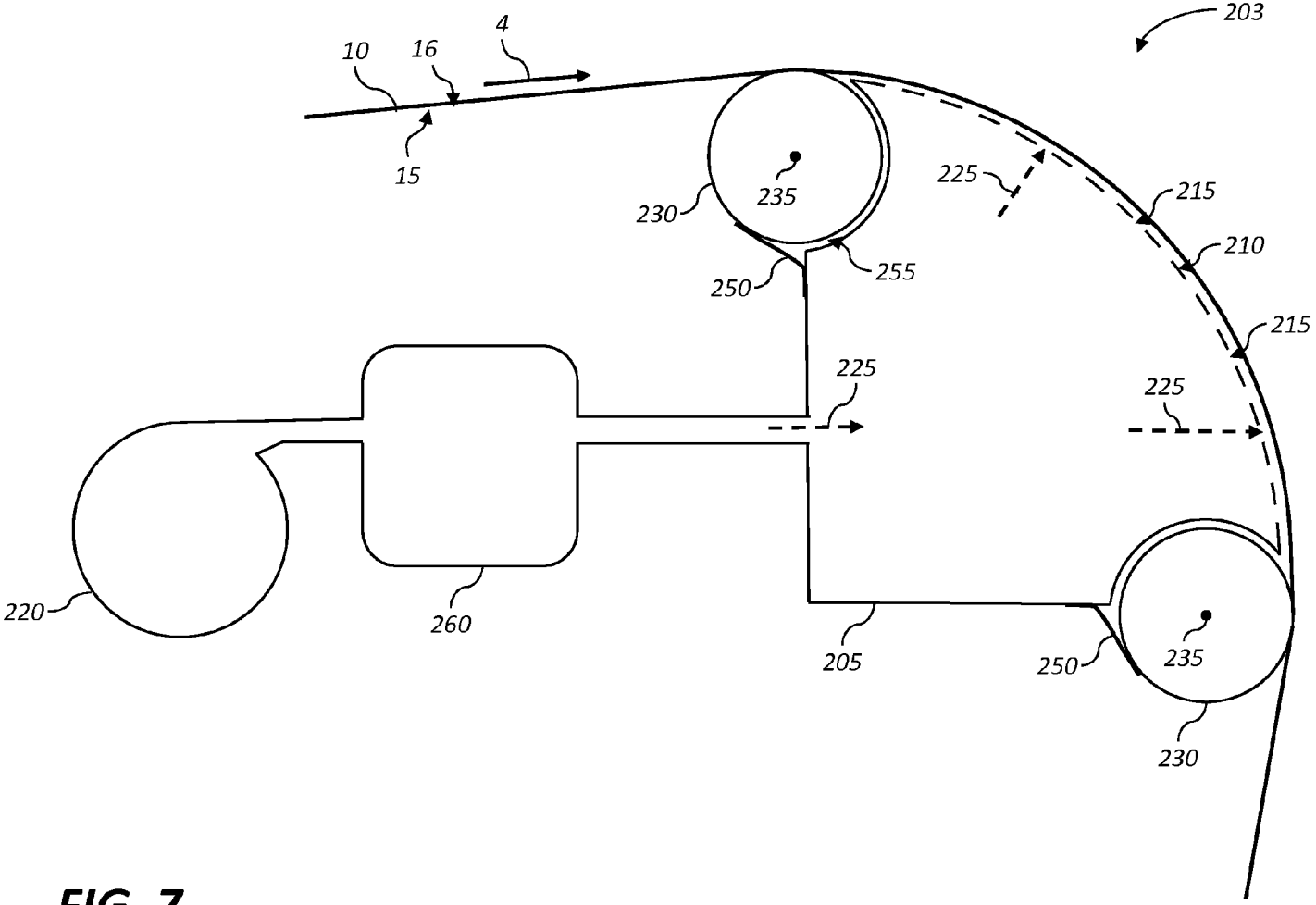
FIG. 7 shows a schematic side-view diagram illustrating a web-guiding system which includes a fixed web-guiding structure and two web-guiding rollers which are recessed into the fixed web-guiding structure in accordance with an alternate embodiment.
Figure 8:
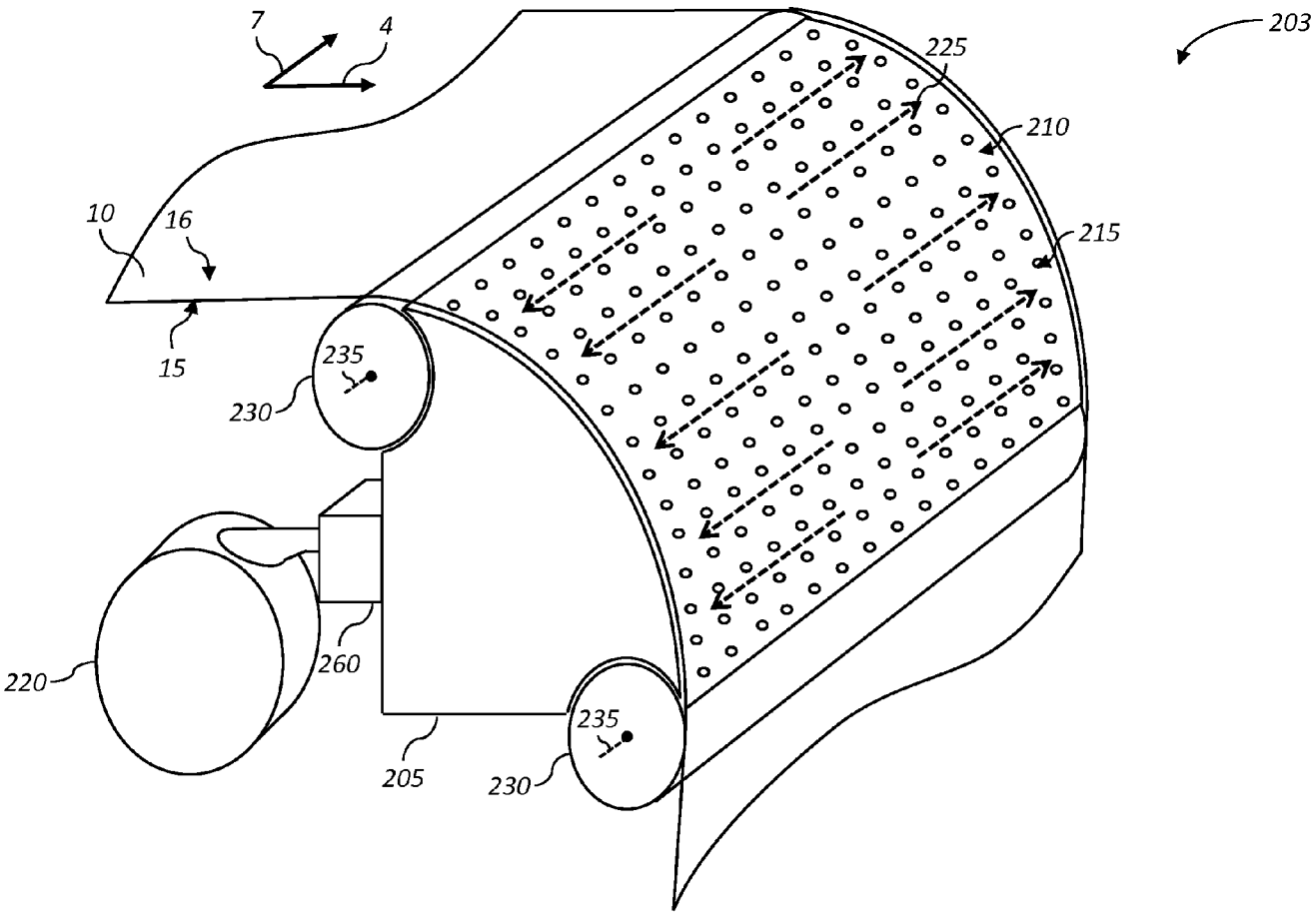
FIG. 8 is a perspective drawing showing the web-guiding system of FIG. 7.

FIGS. 7 and 8 show another embodiment of a web-guiding system 203 in which the web-guiding rollers 230 are integrated into fixed web-guiding structure 205. This allows the web-guiding rollers 230 to be aligned with the fixed web-guiding structure 205 with more precision. The contact of the web of receiver media 10 against the web-guiding rollers 230 forms an air seal, preventing air 225 from passing between the web-guiding rollers 230 and the web of receiver media 10. When the web-guiding rollers 230 are recessed into the fixed web-guiding structure 205 such that there is only a small gap between the web-guiding roller 230 and the leading edge or the trailing edge of the fixed web-guiding structure 205, it blocks most of the air 225 from escaping along the leading edge and the trailing edge of the fixed web-guiding structure 205. By blocking the flow of air from along the leading and trailing edges of the fixed web-guiding structure 205, the integration of the web-guiding rollers 230 into the fixed web-guiding structure 205 can reduce the required flow rate for the air 225 necessary to float the receiver media 10 over the surface of the fixed web-guiding structure 205. Another advantage of providing air seals along the leading and trailing edges of the fixed web-guiding structure 205 is that more of the air 225 must escape from the region between the fixed web-guiding structure 205 and the receiver media 10 by flowing laterally (i.e., in a cross-track direction 7) as shown in FIG. 8. This lateral flow of air 225 provides a lateral force on the web of receiver media 10 which tends to spread the receiver media 10 in the cross-track direction 7, thereby further discouraging the formation of wrinkles Preferably, at least 80% of the air 225 exits the region between the web of receiver media 10 and the fixed web-guiding structure 205 in a lateral direction. Therefore, it can be seen that the use of two web-guiding rollers 230 positioned immediately adjacent to the leading and trailing edges of the fixed web-guiding structure 205 provides a further enhancement in the spreading of the web of the receiver media 10 when compared to the use of a single web-guiding roller 230 as in the embodiments of FIGS. 4A-4B, and also compared to the placement of the web-guiding rollers 230 at a larger distance from the fixed web-guiding structure 205 as shown in FIG. 5.

The web-guiding rollers 230 must be spaced away at least a small gap distance away from the fixed web-guiding structure 205 to enable the web-guiding rollers 230 to rotate freely. The gap 255 provides a leakage path for air 225 to escape from out between the fixed web-guiding structure 205 and the receiver media 10. It is desirable to limit the amount of air 225 that flows through the gap 255. In the embodiment shown in FIGS. 7-8, the gap 255 is configured to have an extended length, by partially recessing the web-guiding rollers 230 within the fixed web-guiding structure 205. Preferably, the web-guiding rollers 230 are recessed within the fixed web-guiding structure 205 for at least 20% of their circumference. The extended length of the gap 255 provides impedance to the flow of air 225 through the gap 255, thereby limiting the leakage of air 225 through the gap 255. Preferably, the width of the gap is less than about 0.01 inches. In one exemplary embodiment, the width of the gap 255 is about 0.003 inches, and the gap 255 extends around about 35% of the circumference of the web-guiding roller 230. The leakage of air 225 though the gap 255 can also be limited by using air seals 250 to further limit the flow of air 225 from escaping through the gap 255 between the fixed web-guiding structure 205 and the web-guiding rollers 230. In some embodiments, the air seals 250 can be fabricated using flexible sealing foil which provides a sliding seal across the exit of the gap 255. The use of air seals has the advantage that it can reduce the required flow rate for the air 225 necessary to float the receiver media 10 over the surface of the fixed web-guiding structure 205.

In some embodiments, an air conditioning subsystem 260 is included to condition the air 225 before it exits the air holes 215 in the fixed web-guiding structure 205. In the embodiment of FIGS. 7 and 8, the air conditioning subsystem 260 is located between the air source 220 and the fixed web-guiding structure 205. In alternative configurations, the air conditioning subsystem 260 can be positioned in other locations, such as internal to the fixed web-guiding structure 205, internal to the air source 220, or at an inlet to the air source 220. Depending on the application, the air conditioning subsystem 260 can be selected to perform various conditioning functions such as cooling the air, heating the air, altering the humidity of the air, or enriching or depleting the concentration of particular gases that may react with, or be inert with respect to, the ink or receiver media 10. Using the air conditioning subsystem 260 in combination with the embodiments which use recessed web-guiding rollers 230 to limit the air leakage in the upstream and downstream directions has the advantage that it reduces the required flow rate of the air 225 that must be conditioned by the air conditioning subsystem 260.

Figure 9:
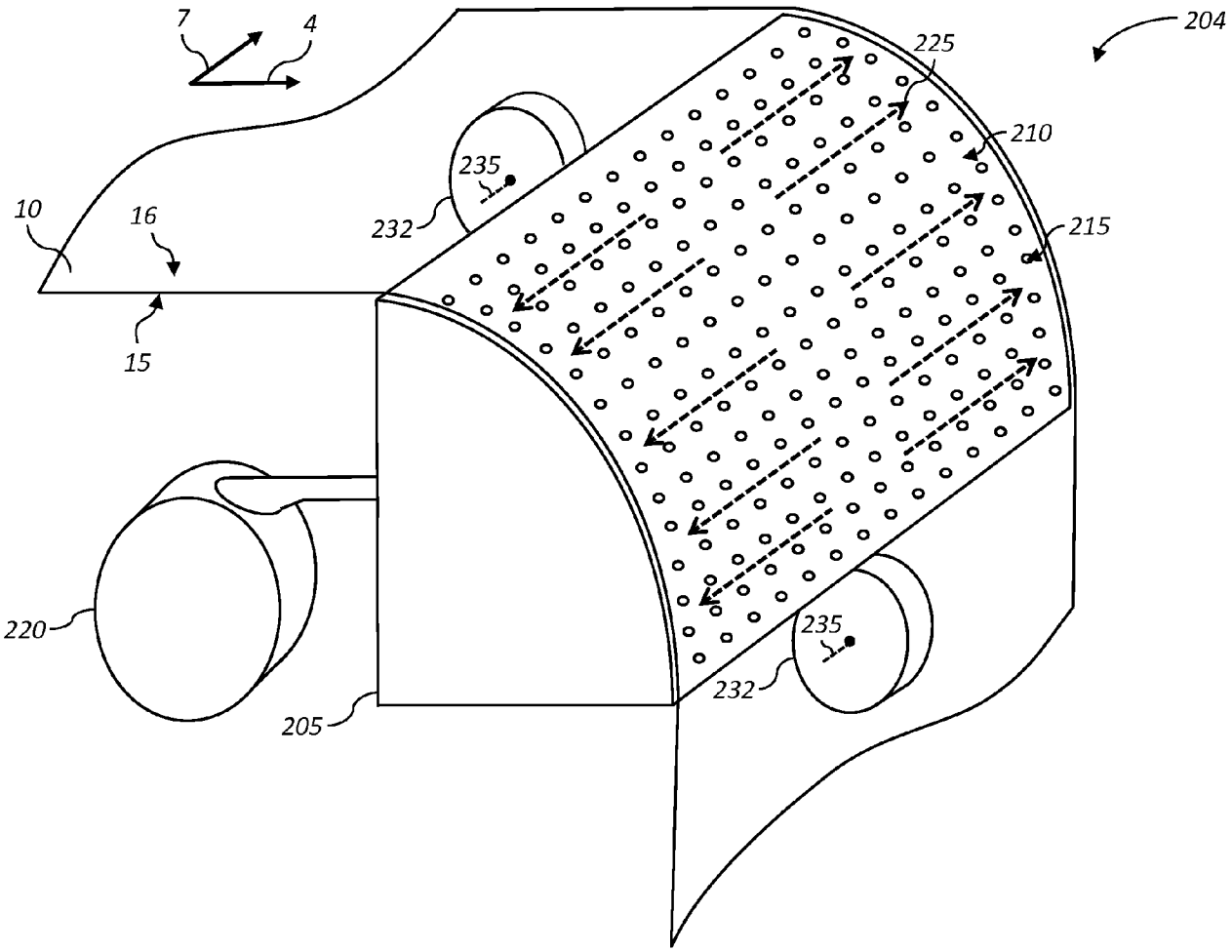
FIGS. 9-10 are perspective drawings showing variations of the web-guiding system of FIG. 8 incorporating narrow web-guiding rollers.

In some embodiments, the web-guiding rollers 230 extend across the entire width of the receiver media 10 as shown in FIGS. 6 and 8. In other embodiments, narrow web-guiding rollers 232 can be used, which are narrow when compared to the width of the web of receiver media 10 as illustrated in the web-guiding system 204 of FIG. 9. For example, the width of the narrow web-guiding rollers 232 (in the direction of the roller axis 235) can be less than about 20% of the cross-track width of the web of receiver media 10.

The narrow web-guiding rollers 232, like the full-width web-guiding rollers 230 (FIG. 6), provide a lateral constraint to the web of receiver media 10 to prevent the cross-track drifting or wandering of the web of receiver media 10. The narrow web-guiding rollers 232 provide a lateral constraint to that portion of the web of receiver media that contacts the narrow guiding roller. When the narrow web-guiding rollers 232 are centrally located across the width of the web of receiver media 10, they provide the lateral constraint to the center of the web, while not imposing a lateral constraint on the portions of the web which are spaced away from the center of the web. This has the advantage that it permits the receiver media 10 to expand laterally away from the centerline of the web when moistened, while preventing an overall lateral drift to the web of receiver media 10. As the receiver media 10 can freely expand or contract in the cross track direction, the height of any flutes that may be present can be reduced prior to reaching the fixed web-guiding structure 205.

Figure 10:
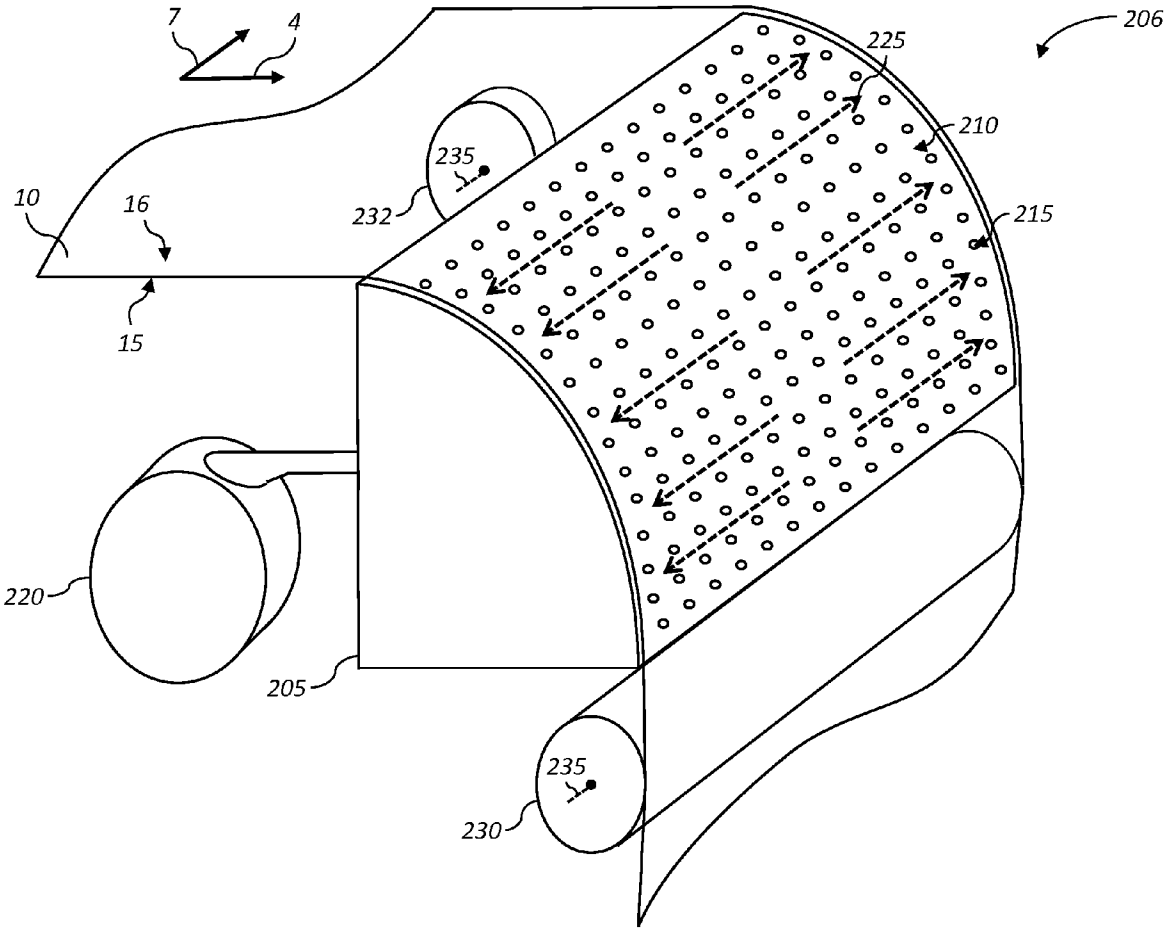

FIG. 10 illustrates an embodiment of a web-guiding system 206 where the web-guiding roller 230 downstream of the fixed web-guiding structure 205 spans the entire width of the web of receiver media 10, while a narrow web-guiding roller 232 is used upstream of the fixed web-guiding structure 205. The upstream narrow web-guiding roller 232 prevents lateral drifting of the web of receiver media 10 while allowing for lateral expansion or shrinkage of the receiver media 10 as in the FIG. 9 embodiment. As the web of receiver media 10 wraps around the fixed web-guiding structure 205, the receiver media 10 spreads laterally to flatten any flutes which may have initially been present. The use of a wide web-guiding roller 230 downstream of the fixed web-guiding structure 205 can inhibit the newly spread receiver media 10 from contracting laterally downstream of the fixed web-guiding structure 205.

Figure 11:
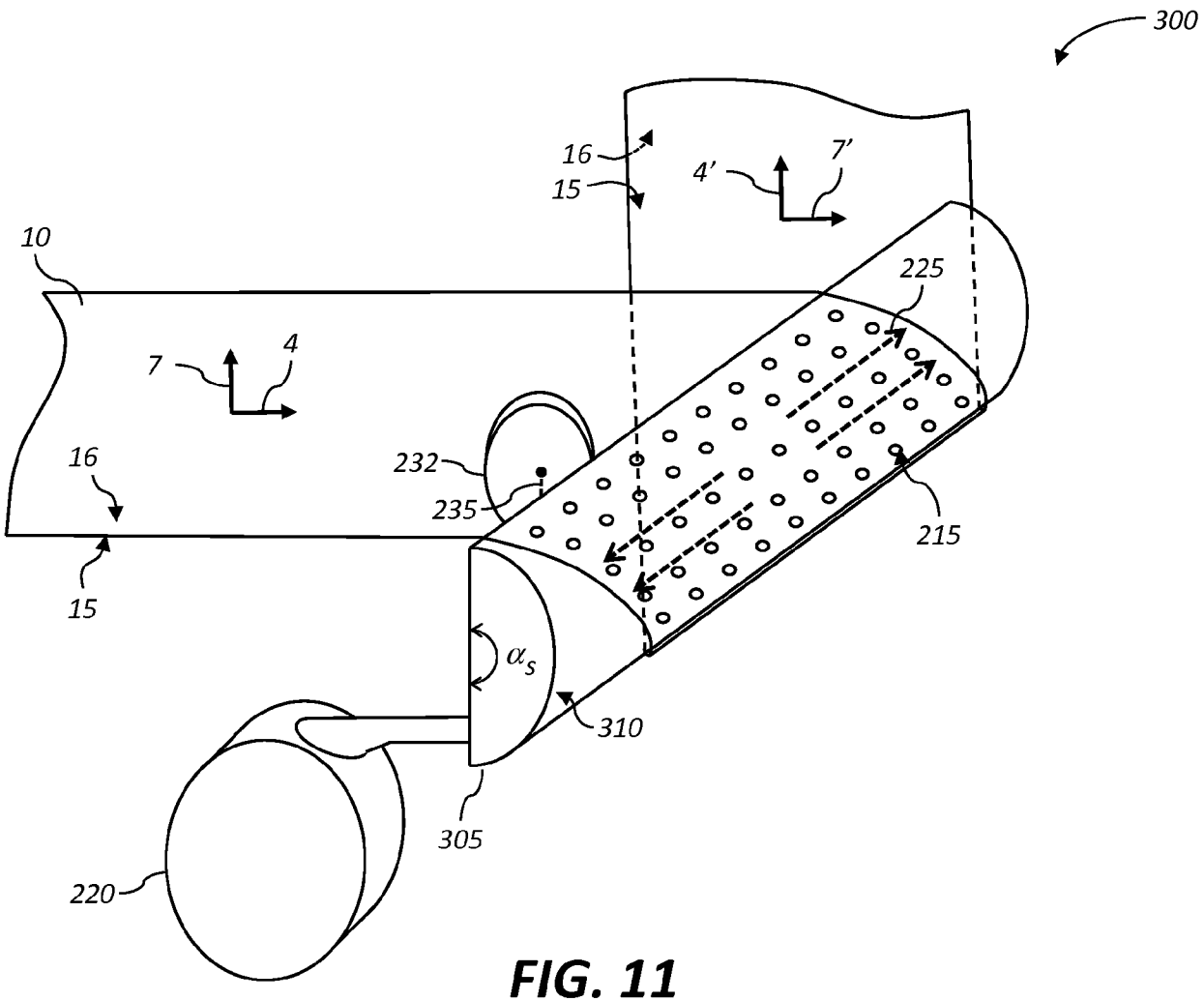
FIG. 11 is a perspective drawing showing a web-guiding system wherein the fixed web-guiding structure is used to provide a turn-bar function.

As illustrated in FIG. 11, the principles of the present invention can also be applied to turn-bar systems, which are used to turn over the web of receiver media 10. Turn-bar system 300 includes a fixed web-guiding turn-bar structure 305, together with a narrow web-guiding roller 232 located in proximity to the fixed web-guiding turn-bar structure 305. The narrow web-guiding roller 232 is positioned so that it contacts the first side 15 of receiver media 10 upstream of the fixed web-guiding turn-bar structure 305.

The fixed web-guiding turn-bar structure 305 is oriented at an oblique angle relative to the initial in-track direction 4 for the web of receiver media 10. In this example, the receiver media 10 is wrapped around the convex exterior surface 310 of the fixed web-guiding turn-bar structure 305 for a wrap angle $\alpha_s$ of about 180°, and the fixed web-guiding turn-bar structure 305 is angled by about 45 degrees relative to the initial in-track direction 4 so that the receiver media 10 exits the turn-bar system 300 with a new in-track direction 4' and a new cross-track direction 7', which are rotated approximately 90° relative to the input directions. As the receiver media 10 exits the turn-bar system 300, the receiver media 10 has been inverted so that the first side 15 is now on top, and the second side 16 is on the bottom.

In the illustrated embodiment, the convex exterior surface 310 of the exemplary fixed web-guiding turn-bar structure 305 has a semi-circular profile. In other embodiments, the convex exterior surface 310 can subtend a complete circle (e.g., to provide additional stiffness), or can subtend an arc somewhere between 180° and 360°.

The fixed web-guiding turn-bar structure 305 includes a pattern of air holes 215 formed in the exterior surface 310 through which air 225 from air source 220 flows to lift the web of receiver media 10 away from the fixed web-guiding turn-bar structure 305 such that the first side 15 of the web of receiver media 10 is substantially not in contact with the exterior surface 310. Preferably the air holes 215 are positioned only in those portions of the exterior surface 310 over which are covered by the receiver media 10.

The narrow web-guiding roller 232 is oriented such that the roller axis 235 is substantially perpendicular to the in-track direction 4 in which the receiver media 10 is travelling upstream of the fixed web-guiding turn-bar structure 305. Preferably, the narrow web-guiding roller 232 is positioned so that it contacts the web of receiver media 10 near the centerline of the web. The lateral constraint provided to the web of receiver media 10 by the narrow web-guiding roller 232 reduces the tendency of the web to drift laterally in response to tension changes as the web wraps around the angled fixed web-guiding turn-bar structure 305. The use of a narrow web-guiding roller 232 enables the lateral constraint to be applied to the web in closer proximity to the fixed web-guiding turn-bar structure 305 than would be possible with a wide web-guiding roller 230 (FIG. 6).

Figure 12:
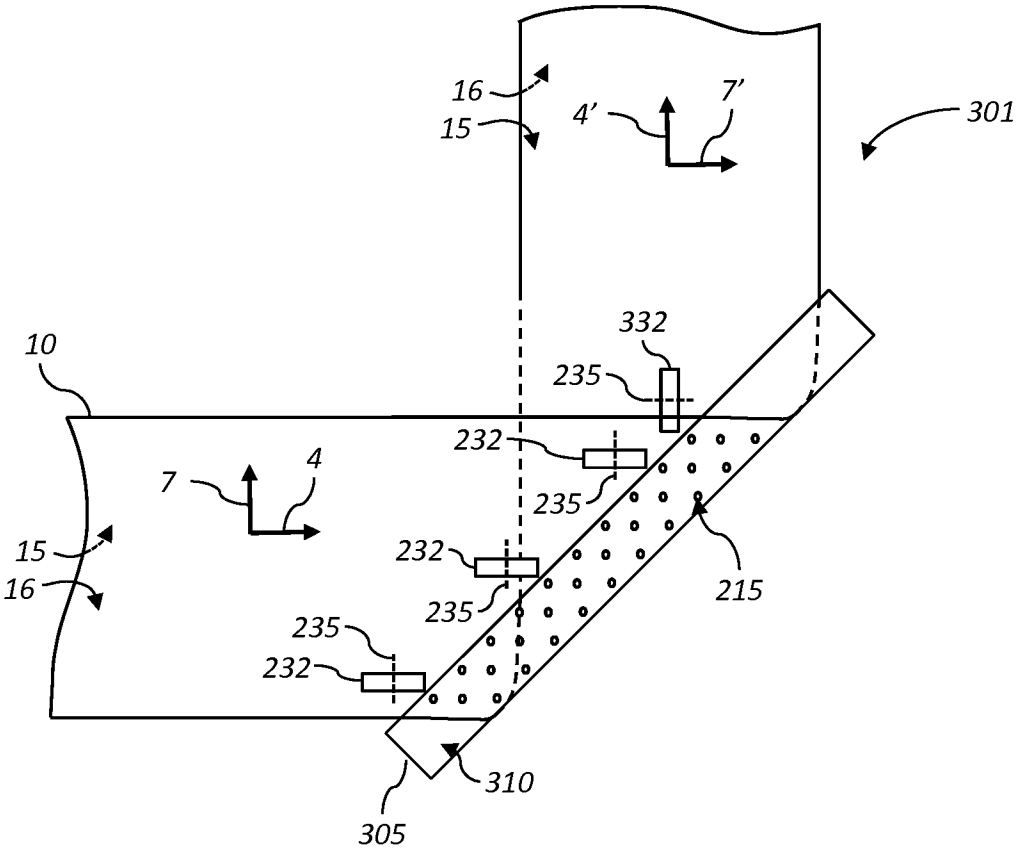
FIG. 12 shows a schematic top-view diagram illustrating a web-guiding turn-bar system incorporating a plurality of web-guiding rollers in accordance with an alternate embodiment.

FIG. 12 shows a top-view of another embodiment of a turn-bar system 301 in which there are a plurality of narrow web-guiding rollers 232 located at different lateral locations across the web of receiver media 10 upstream of the fixed web-guiding turn-bar structure 305. (Note that the air source 220 is not shown in this figure for clarity.) The narrow web-guiding rollers 232 are positioned so that they contact the first side 15 of receiver media 10. The use of multiple narrow web-guiding rollers 232 in this embodiment can further reduce the tendency of the web of receiver media 10 to wander relative to the embodiment shown in FIG. 11 which uses only a single narrow web-guiding roller 232.

FIG. 12 also shows an additional narrow web-guiding roller 332 positioned downstream of the fixed web-guiding turn-bar structure 305. The narrow web-guiding roller 232 is positioned so that it contacts the first side 15 of receiver media 10 downstream of the fixed web-guiding turn-bar structure 305 to provide a lateral constraint to the web of receiver media 10 as it leaves the turn-bar system 301. The roller axis 235 of the narrow web-guiding roller 332 is oriented so that it is substantially perpendicular to the new in-track direction 4'.

Figure 13:
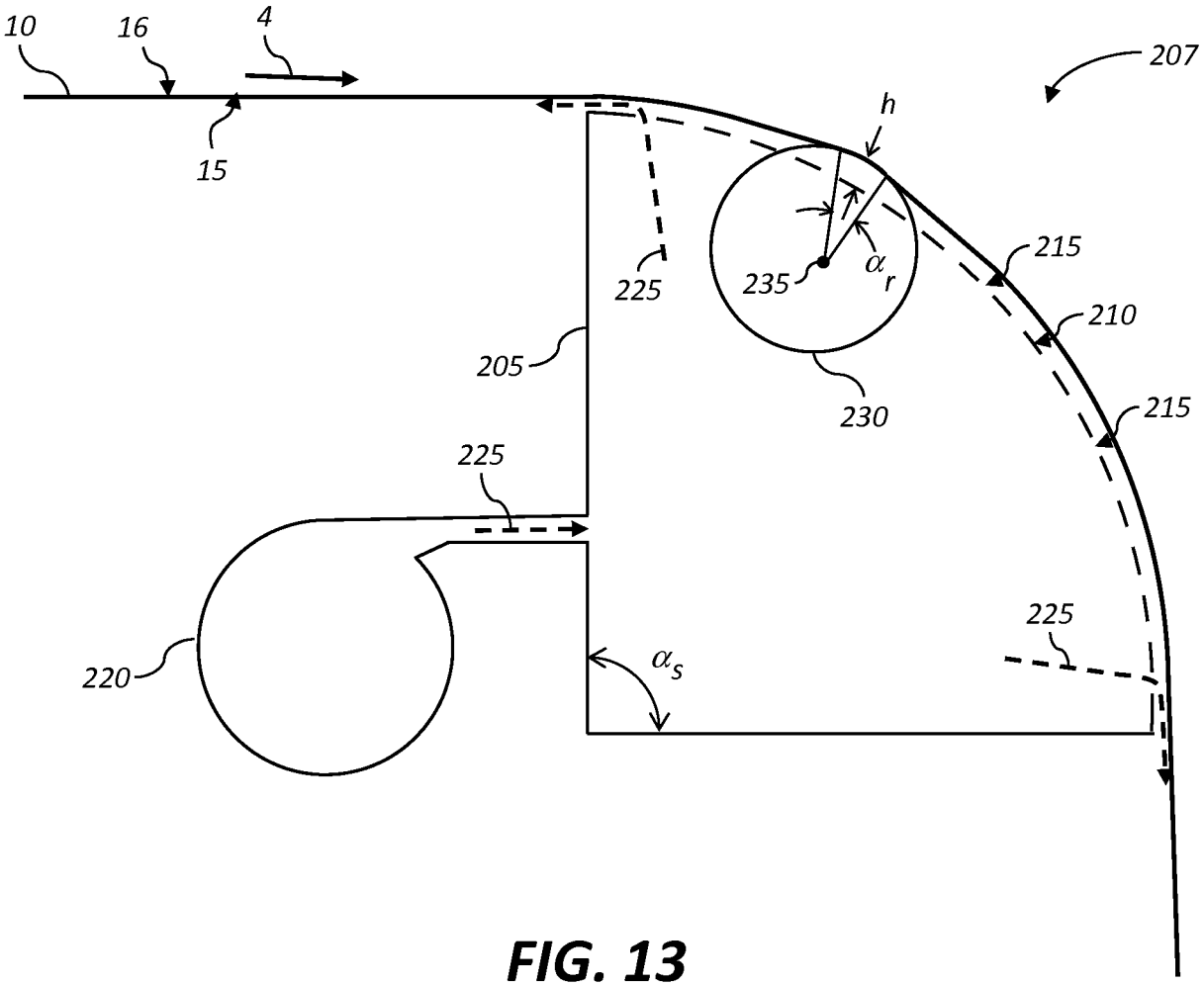
FIG. 13 shows a schematic side-view diagram illustrating a web-guiding system which includes a web-guiding roller protruding through a fixed web-guiding structure in accordance with an alternate embodiment.
Figure 14:
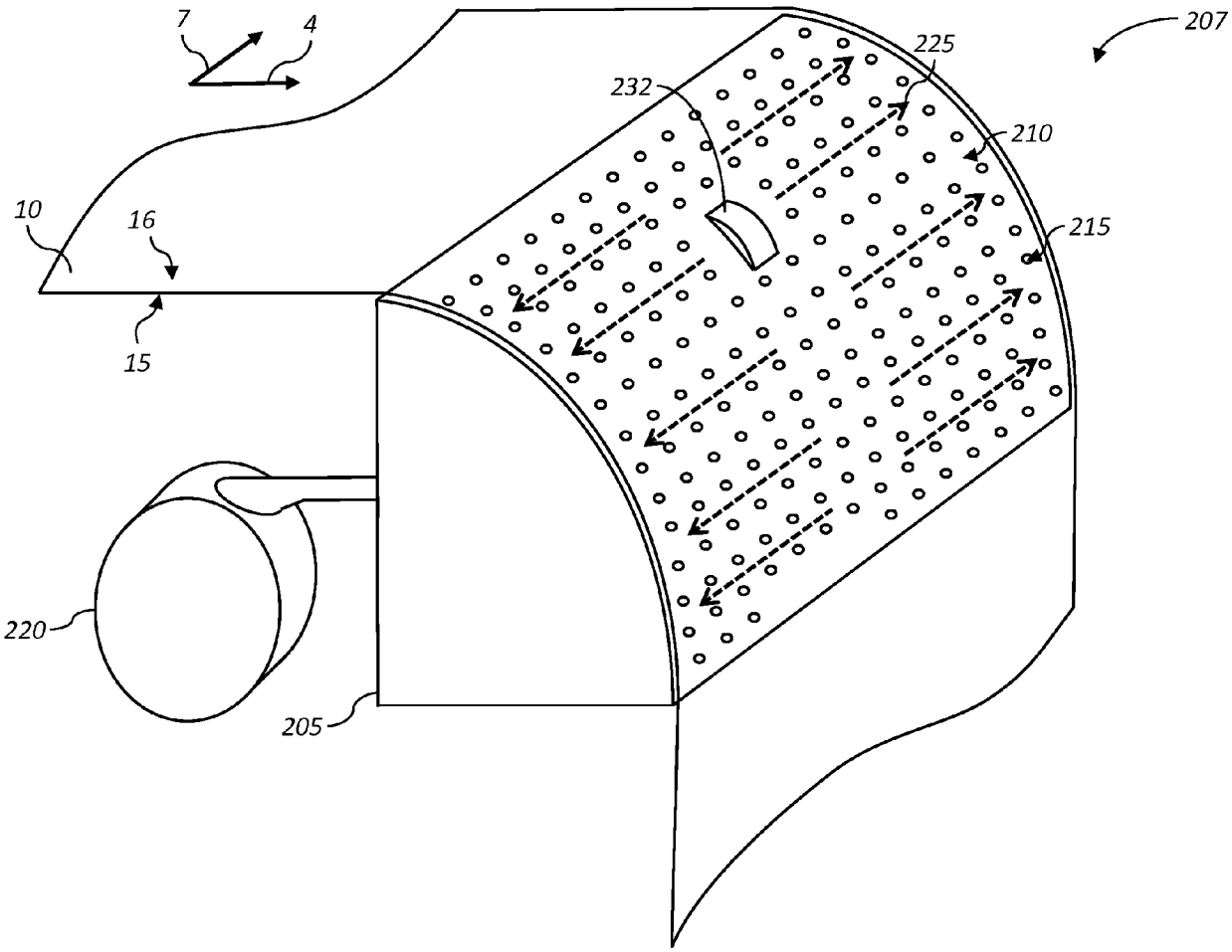
FIG. 14 is a perspective drawing showing the web-guiding system of FIG. 13.

FIGS. 13-14 illustrate another embodiment of a web-guiding system 207 in which the narrow web-guiding roller 232 is positioned so that it protrudes through the exterior surface 210 of the fixed web-guiding structure 205 by a small height h. The height h that the narrow web-guiding roller 232 protrudes through the exterior surface 210 is chosen such that it contacts the receiver media 10 through a wrap angle $\alpha_r$ that provides sufficient traction to impose a lateral constraint on the receiver media 10. The optimal height h will depend on the thickness of the air cushion around the fixed web-guiding structure 205. In a preferred embodiment, the contact angle $\alpha_r$ is less than about 5-10°, and the height h is between 0.1 mm and 4 mm. In some embodiments, a tensioning mechanism (e.g., a spring, a flexure arm, an air cylinder, or an electromechanical actuator) can be used to push the web-guiding roller 232 into contact with the receiver media 10, thereby automatically adjusting the height h to accommodate variations in the thickness of the air cushion around the fixed web-guiding structure 205.

Figure 15:
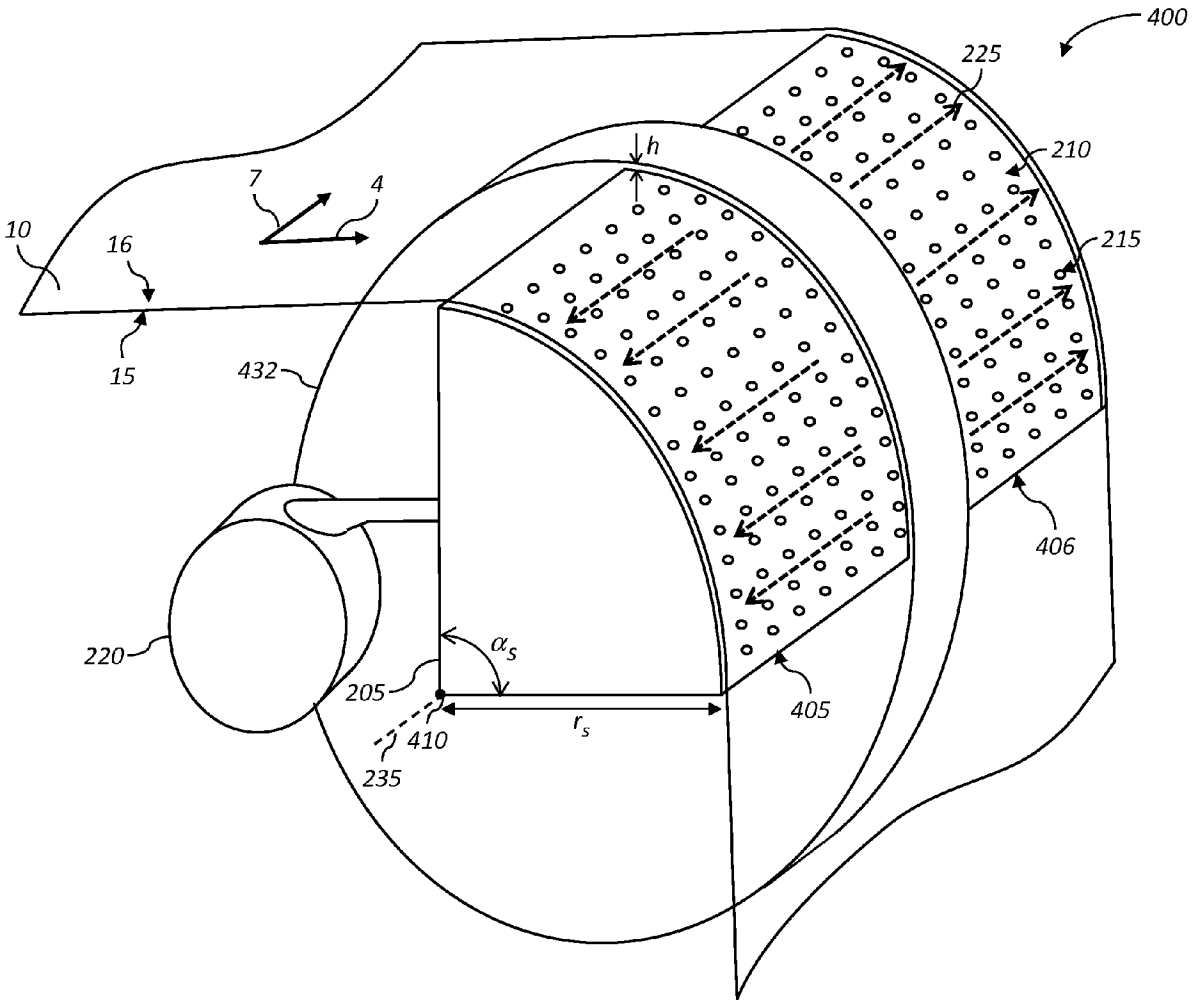
FIG. 15 shows a schematic side-view diagram illustrating a web-guiding system which includes two fixed web-guiding structure sections on either side of a web-guiding roller in accordance with an alternate embodiment.

FIG. 15 shows another embodiment of a web-guiding system 400 in which the web of receiver media 10 travels around the fixed web-guiding structure 205 with air 225 flowing through the air holes 215 and lifting the web of receiver media away from the fixed web-guiding structure 205 such that the first side 15 of the web of receiver media 10 is substantially not in contact with the fixed web-guiding structure 205. In this configuration, the fixed web-guiding structure 205 has two fixed web-guiding structure sections 405, 406 which are located on each side of an integrated, centrally-located narrow web-guiding roller 432. The convex exterior surface 210 of the fixed web-guiding structure 205 has an arc-shaped profile with a radius of curvature $r_s$ and a center of curvature 410 which is aligned with the roller axis 235 of the narrow web-guiding roller 432. The narrow web-guiding roller 432 has a radius of curvature that is slightly larger than the radius of curvature $r_s$ of the fixed web-guiding structure 205 so that it protrudes through the exterior surface 210 of the fixed web-guiding structure 205 by a height h. The optimal height h will depend on the thickness of the air cushion around the fixed web-guiding structure 205. In a preferred embodiment, the height h is between 0.1 mm and 4 mm. Because the receiver media 10 is substantially not in contact with the two fixed web-guiding structure sections 405, 406, the receiver media can wrap around the fixed web-guiding structure 205 without risk of wrinkling. In some embodiments, a tensioning mechanism (e.g., a spring, a flexure arm, an air cylinder, or an electro-mechanical actuator) can be used to push the narrow web-guiding roller 432 into contact with the receiver media 10, thereby automatically adjusting the height h to accommodate variations in the thickness of the air cushion around the fixed web-guiding structure 205.

The centrally-located narrow web-guiding roller 432 provides a lateral constraint to the web of receiver media 10 to prevent lateral drifting of the web. The central location of the narrow web-guiding roller 432 between the two fixed web-guiding structure sections 405, 406 allows the receiver media 10 to expand and contract in the cross-track direction to accommodate cross-track dimensional changes in the receiver media 10. This provides a distinct advantage when compared to the aforementioned U.S. Pat. No. 6,427,941, where cross-track width changes in the receiver media are inhibited due to the placement of web-contacting edge rollers on both side of a central air bearing structure.

In the FIG. 15 embodiment, the wrap angle around the narrow web-guiding roller 432 is substantially equivalent to the wrap angle $\alpha_s$ around the fixed web-guiding structure 205, and is therefore relatively large. However, because the narrow web-guiding roller 432 has a small lateral width, there is little risk that the receiver media 10 passing over the narrow web-guiding roller 432 will form a wrinkle even if a flute were to be aligned with the narrow web-guiding roller 432.

Figure 16:
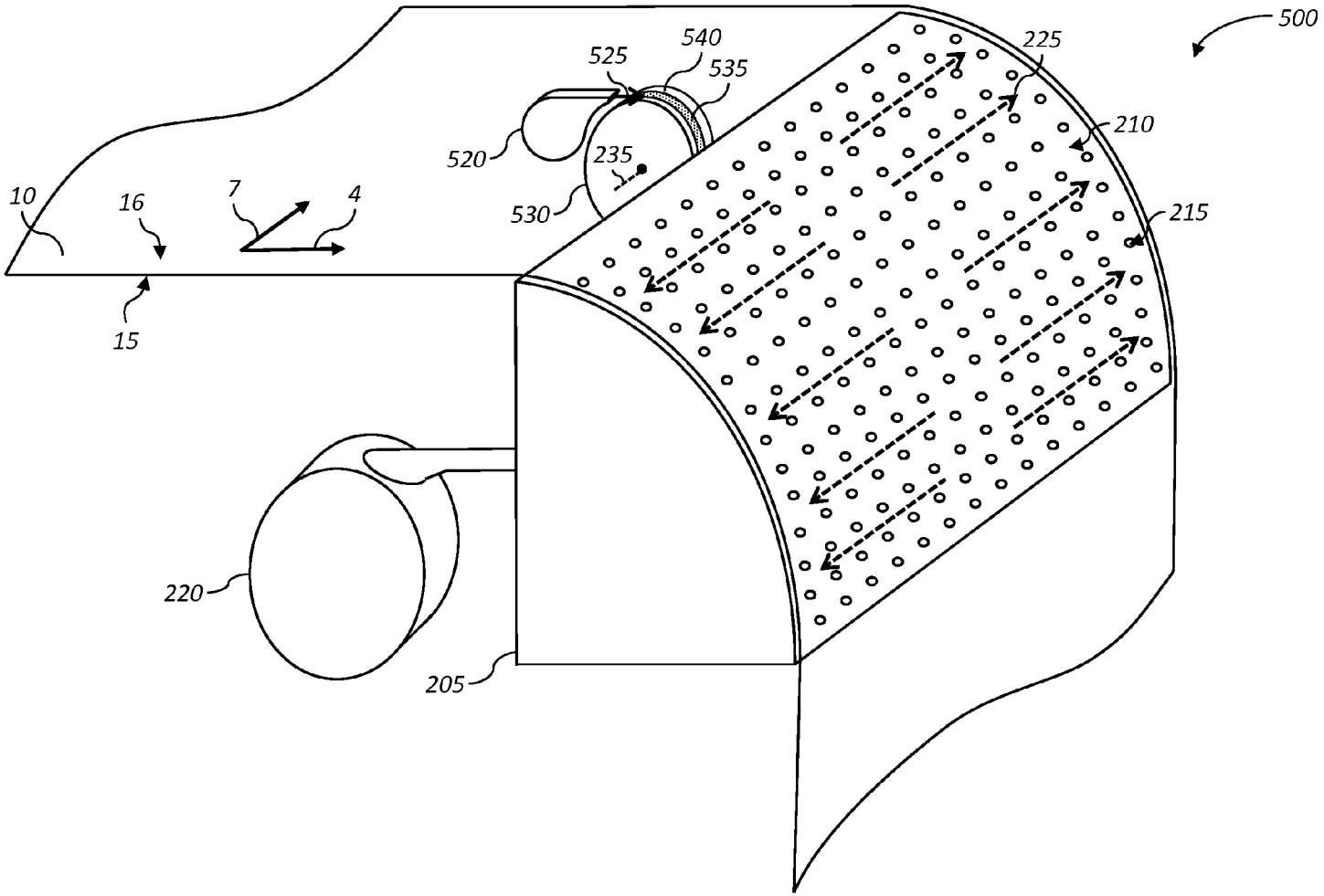
FIG. 16 is a perspective diagram illustrating a web-guiding system which includes a grooved web-guiding roller providing a Bernoulli force and a fixed web-guiding structure in accordance with an alternate embodiment.
Figure 17:
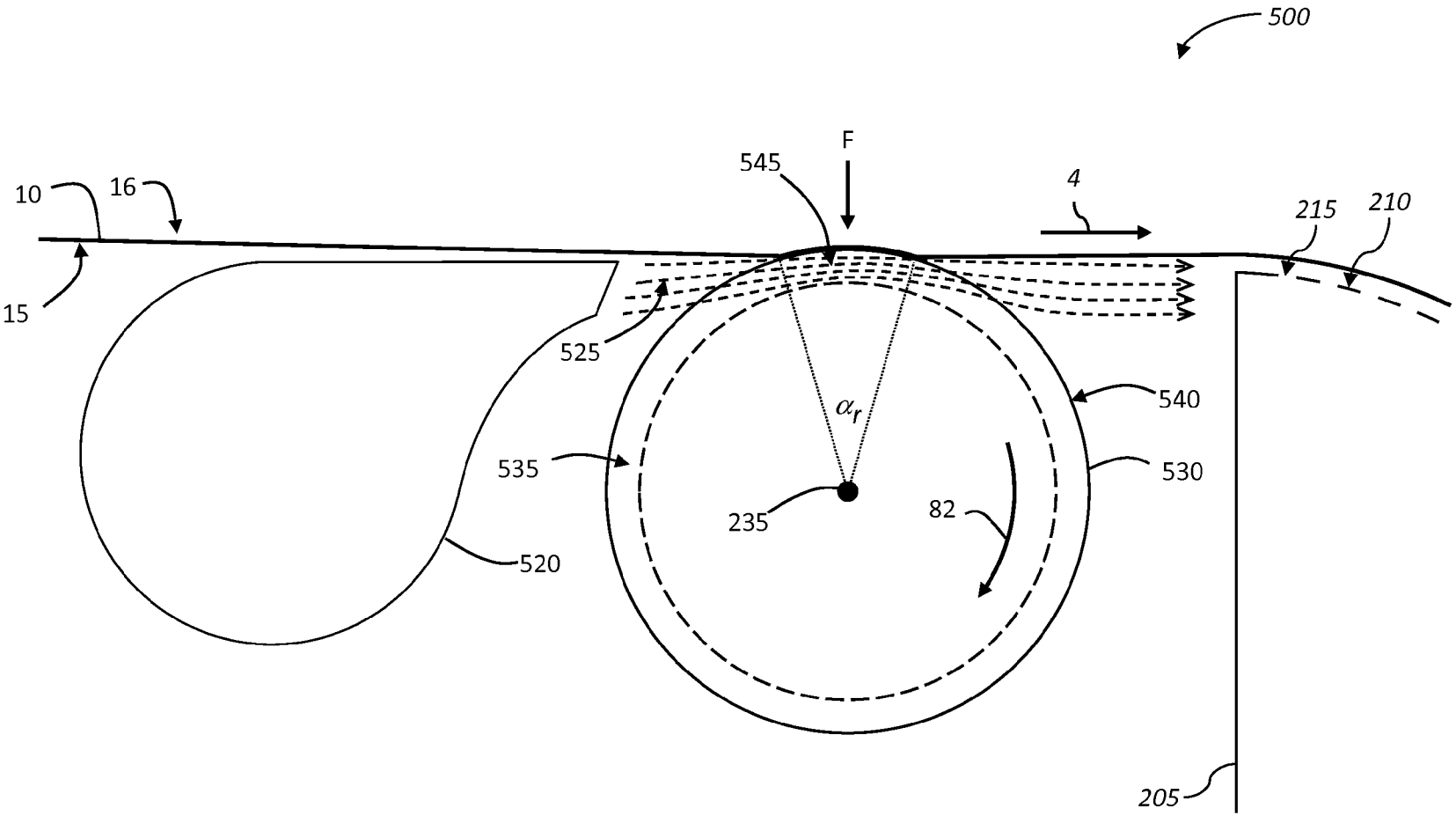
FIG. 17 is a schematic side-view diagram showing a portion of the web-guiding system of FIG. 16.

FIGS. 16 and 17 show a web-guiding system 500 according to an alternate embodiment which uses the approach described in commonly assigned, U.S. patent application Ser. No. 14/190,125, entitled "Media guiding system using Bernoulli force roller," by Muir et al., which is incorporated herein by reference, to provide an enhanced traction between the receiver media 10 and grooved web-guiding roller 530. The fixed web-guiding structure 205 and air source 220 function in the same manner as has been described earlier with respect to FIG. 4A so that air 225 flowing through a pattern of air holes 215 lift the web of receiver media 10 away from the exterior surface 210 of the fixed web-guiding structure 205.

The grooved web-guiding roller 530 is positioned in proximity to the fixed web-guiding structure 205, and includes at least one groove 535 formed in around its exterior surface 540. A roller air source 520 directs an airflow 525 into the groove 535, the air flow being directed between the first side 15 of the receiver media 10 and the exterior surface 540 of the grooved web-guiding roller 530. In a preferred embodiment, the airflow 525 is substantially parallel to the plane of the receiver media 10 (i.e., a vector representing the direction of airflow 525 is within about 10° of being parallel to the in-track direction 4 of the receiver media 10) and to the groove 535 (i.e., a vector representing the direction of airflow 525 is within about 10° of being parallel to a plane through the center of the groove 535, where the plane through the center of the groove 535 will generally be perpendicular to the roller axis 235.)

As is described in more detail in the aforementioned U.S. Patent Application by Muir et al., the use of the grooved web-guiding roller 530 and the airflow 525 provided by the roller air source 520 produce a Bernoulli force F that draws the receiver media 10 down onto the grooved web-guiding roller 530, thereby providing an increased traction. The groove 535 serves as an air channel for the airflow 525. As shown in FIG. 17, as the airflow 525 passes through the groove 535 between the first side 15 of receiver media 10 and the exterior surface 540 of the grooved web-guiding roller 530, the contour of the bottom of the groove 535 forms a constriction 545 to the airflow 525. The well-known "continuity principle" of fluid dynamics requires the airflow 525 to accelerate as it passes through the constriction 545. According to the well-known Bernoulli's Principle, the increased velocity of the airflow 525 at the constriction 545 is accompanied by the development of a low pressure zone between the high point of the groove 535 and the receiver media 10. A pressure differential is therefore developed from the second side 16 to the first side 15 of the receiver media 10, resulting in a Bernoulli force F on the receiver media 10 which draws the receiver media 10 down toward, or into contact with, the exterior surface 540 of the grooved web-guiding roller 530. This increases the wrap angle $\alpha_r$, and thereby increases the traction between the receiver media 10 and the grooved web-guiding roller 530. As a result, the ability of the grooved web-guiding roller 530 to provide a lateral constraint on the web of receiver media 10 is improved, thereby preventing the receiver media 10 from drifting in the cross-track direction 7 (FIG. 16).

While FIGS. 16-17 illustrate the use of a narrow grooved web-guiding roller 530 located upstream of the fixed web-guiding structure 205, it will be obvious to those skilled in the art that the same approach can be used to provide extra traction for any of the rollers shown in FIGS. 4A-15. In some embodiments a plurality of grooves 535 can be provided across the width of the roller. This is particularly appropriate for the wider web-guiding rollers 230 such as those shown in FIG. 6.

In other alternate embodiments (not shown), different methods can be used to increase the traction between the receiver media 10 and the grooved web-guiding roller 530. For example a jet of air directed onto the second side 16 of the receiver media 10 can be used to push the receiver media 10 down onto the web-guiding roller 230 (FIG. 4A). Alternately, an electrostatic force can be used to draw the receiver media 10 down onto the web-guiding roller 230.

In some embodiments, the fixed web-guiding structure 205 include an air flow control mechanism for controlling which air holes 215 the flow of air 225 is provided through. This allows the airflow width to be adjusted in accordance with the width of the web of receiver media 10 so that doesn't flow through air holes 215 that are outside the width of the receiver media 10. FIGS. 18-21 show several exemplary embodiments of air flow control mechanisms that can be used in accordance with the present invention.

Figure 18:
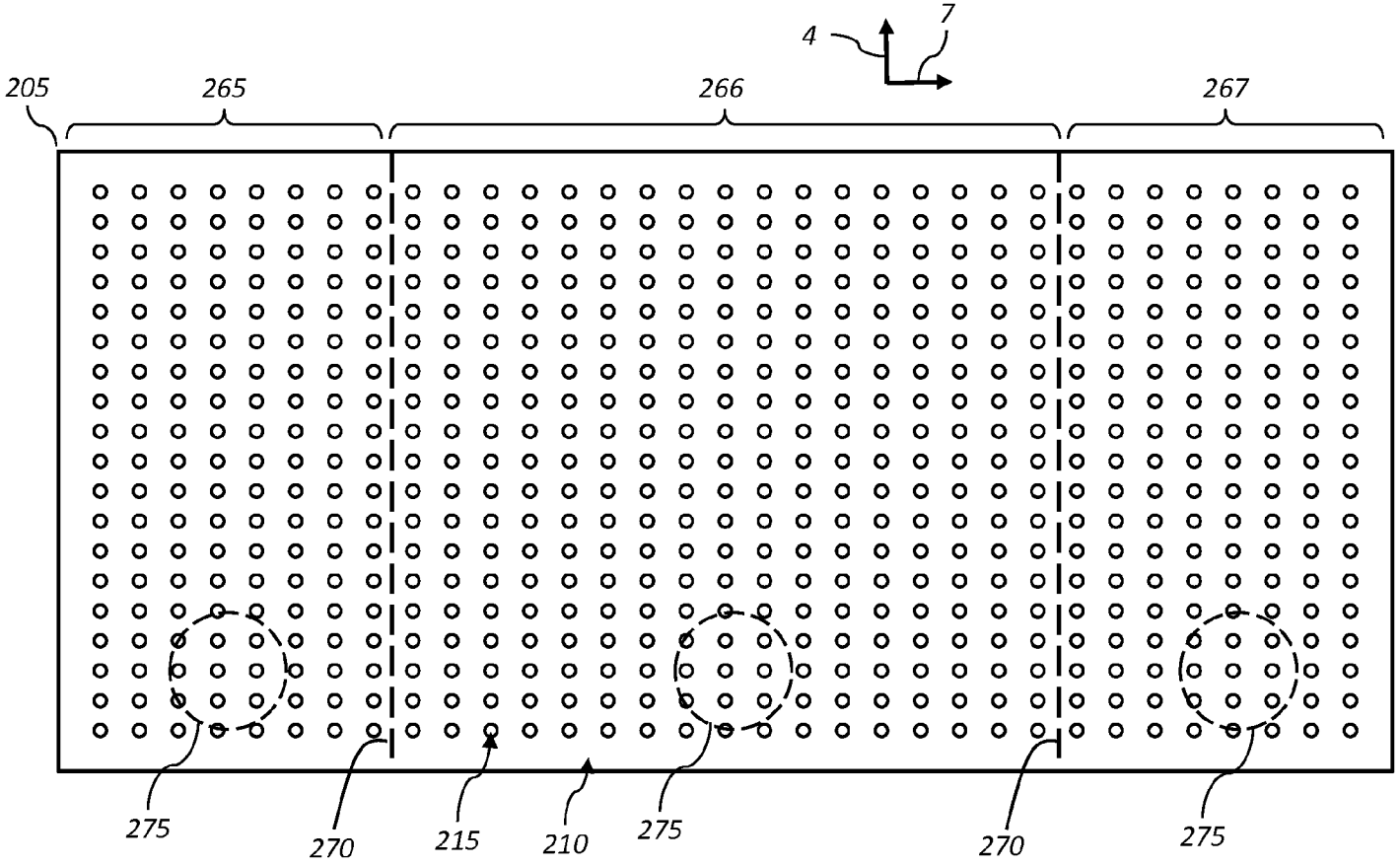
FIGS. 18-21 illustrate exemplary air flow control mechanisms that can be used to control the airflow through the air holes in the fixed web-guiding structures.

FIG. 18 shows a view of the exterior surface 210 of a fixed web-guiding structure 205 which is segmented into a left segment 265, a center segment 266, and a right segment 267. The segments are separated by internal walls 270 which are inside of the fixed web-guiding structure 205 and define a plurality of air chambers corresponding to the left segment 265, the center segment 266, and the right segment 267. The walls are positioned such that the width of the center segment 266 corresponds to the width of a narrow receiver media 10, and the total width of the three segments corresponds to the width of a wide receiver media 10. The air source 220 (FIG. 4A) provides airflow into the fixed web-guiding structure 205 through separate air supply lines (not shown) into three different air supply ports 275, one for each segment. Valves in the air supply lines can be used to turn on and off the airflow to the individual segments to accommodate different receiver media widths. This approach can easily be extended to more than three segments to accommodate additional media widths.

Figure 19:
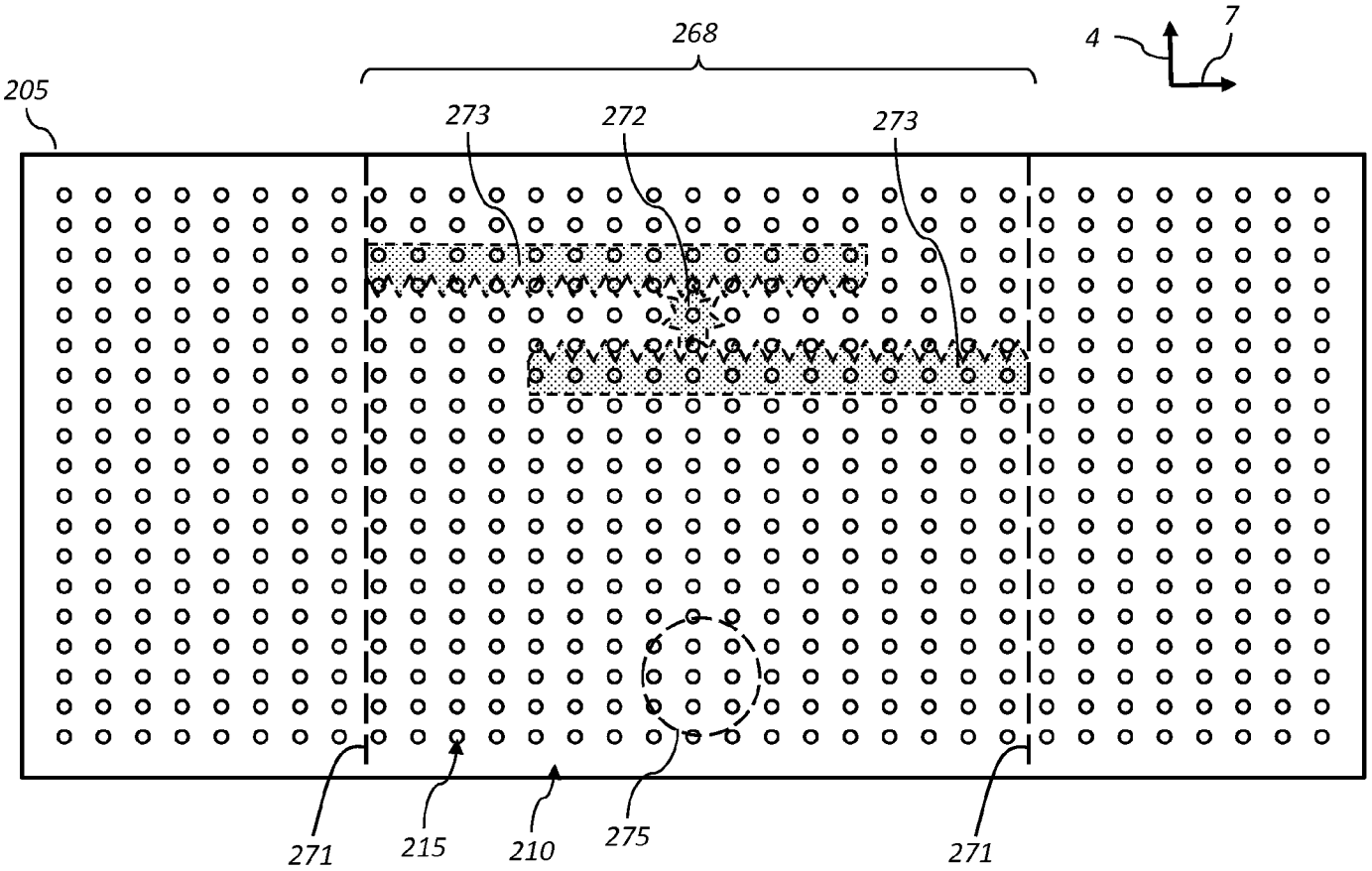

FIG. 19 shows another embodiment in which the air flow control mechanism comprises moveable internal walls 271 within the fixed web-guiding structure 205 that can be moved to adjust the size of an internal air chamber behind the air holes 215 within to an active segment 268 in order to accommodate different media widths. Any mechanism known in the art can be used to adjust the position of the moveable internal walls 271. In the illustrated embodiment, a motorized pinion gear 272 engages rack gears 273 attached to each moveable internal wall 271 to adjust the position of the end walls. Air flows into the fixed web-guiding structure 205 through a central air supply port 275 located between the moveable internal walls 271 so that airflow is only provided in the central active segment 268.

Figure 20:
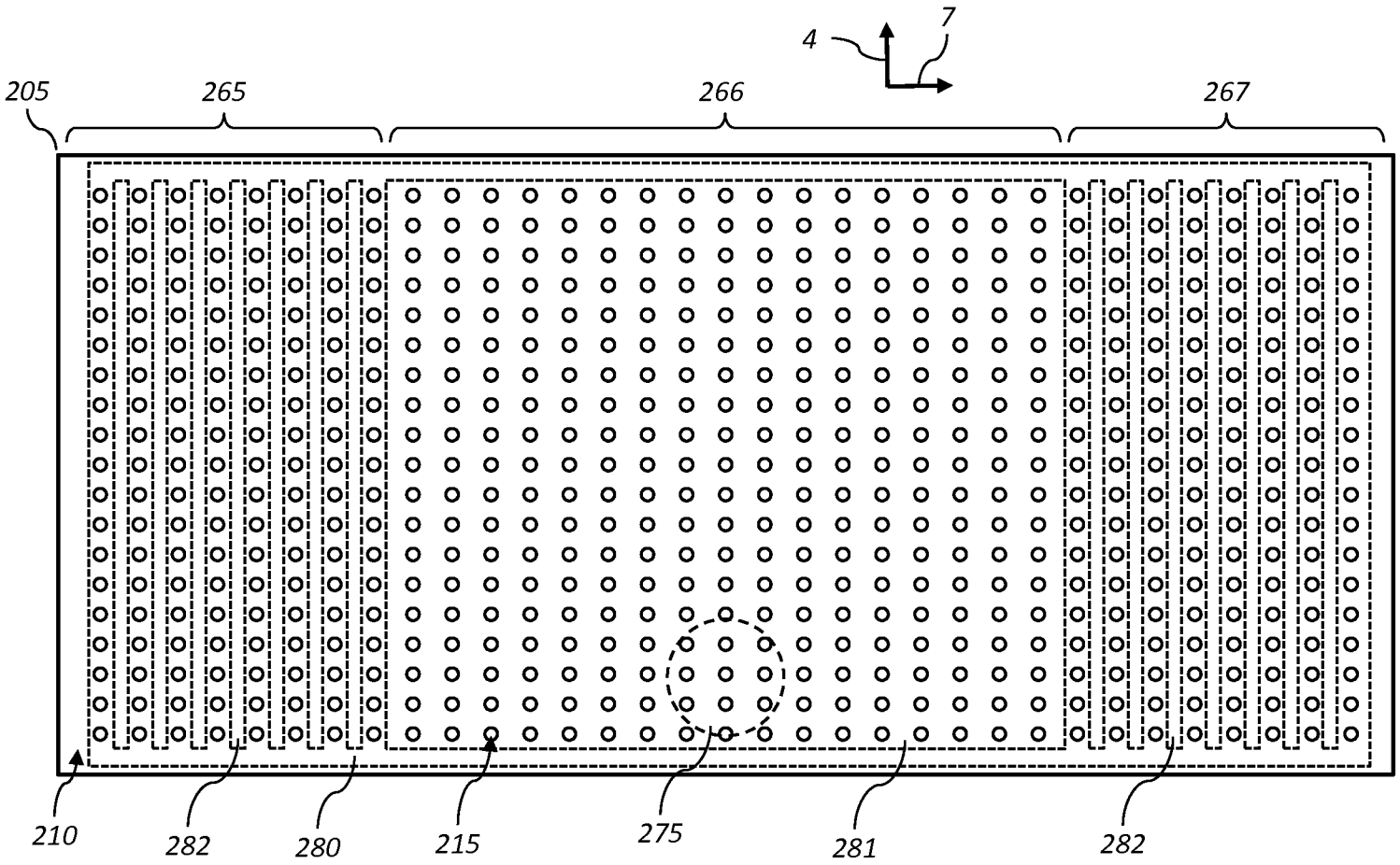
Figure 21:
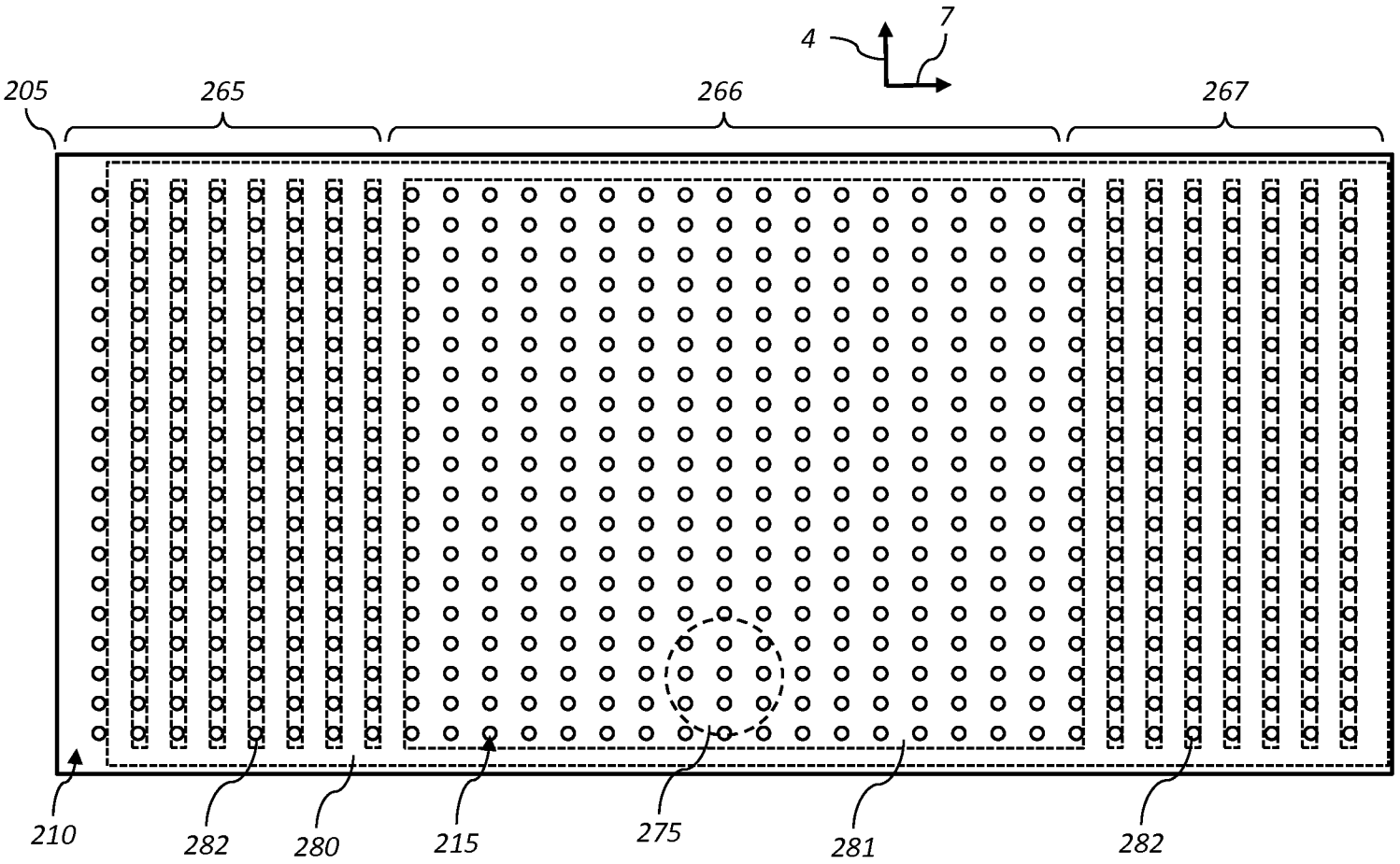

FIGS. 20-21 illustrate another embodiment of an air flow control mechanism which utilizes a moveable louver 280 located inside the fixed web-guiding structure 205, adjacent to the interior side of the exterior surface 210. The louver 280 has a large central louver opening 281 corresponding to the center segment 266 of the fixed web-guiding structure 205 through which air can flow to pass through the air holes 215. In the portions of the louver 280 corresponding to the left segment 265 and the right segment 267, an array of linear louver openings 282 are provided, having the same pitch in the cross-track direction 7 as the air holes 215. The moveable louver 280 can be moved laterally to a position where the array of louver openings 282 in the left segment 265 and the right segment 267 are either aligned with the air holes 215 so that air can pass (as in FIG. 20), or are blocking the air holes 215 so that air cannot pass (as in FIG. 21). When the louver 280 is shifted to the FIG. 20 position, air flows out of the air holes 215 across the entire width of the fixed web-guiding structure to support a wide media width. When the louver 280 is shifted to the FIG. 21 position, air only flows out of the air holes 215 in the center segment 266 of the fixed web-guiding structure to support a narrow media width. While the illustrated louver 280 supports two media widths, it will be obvious to one skilled in the art that other louver patterns can be used can accommodate three or more media widths.

The invention has been described in detail with particular reference to certain preferred embodiments thereof, but it will be understood that variations and modifications can be effected within the spirit and scope of the invention.

PARTS LIST

2 roller
3 receiver media
4 in-track direction
4' new in-track direction
5 flute
7 cross-track direction
7' new cross-track direction
8 contact surface
9 exit direction
10 receiver media
11 source roll
12 take-up roll
15 first side
16 second side
20*a* printhead
20*b* printhead
20*c* printhead
20*d* printhead
21 print line
22 print line
25*a* printhead
25*b* printhead
30 web-guiding system
31 print line roller
32 print line roller
40 dryer
41 dryer roller
45 quality control sensor
50 printing module
51 first zone
52 second zone
55 printing module
60 turnover mechanism
65 printing module
70 web-guiding structure
100 printing system
110 printing system
200 web-guiding system
201 web-guiding system
202 web-guiding system
203 web-guiding system
204 web-guiding system
205 fixed web-guiding structure
206 web-guiding system
207 web-guiding system
210 exterior surface
215 air holes
220 air source
225 air
230 web-guiding roller
232 narrow web-guiding roller
235 roller axis
240 tensioning mechanism
245 tensioning mechanism
250 air seal
255 gap
260 air conditioning subsystem
265 left segment
266 center segment
267 right segment
268 active segment
270 internal wall
271 moveable internal wall
272 pinion gear
273 rack gear
275 air supply port
280 louver
281 central louver opening
282 louver opening
300 turn-bar system
301 turn-bar system
305 fixed web-guiding turn-bar structure
310 exterior surface
332 narrow web-guiding roller
400 web-guiding system
405 fixed web-guiding structure section
406 fixed web-guiding structure section
410 center of curvature
432 narrow web-guiding roller
500 web-guiding system
520 roller air source
525 airflow
530 grooved web-guiding roller
535 groove
540 exterior surface
545 constriction
F Bernoulli force
h height
$r_s$ radius of curvature
$\alpha_s$ wrap angle
$\alpha_r$ wrap angle
$\alpha_{r1}$ wrap angle
$\alpha_{r2}$ wrap angle

The invention claimed is:

1. A web-guiding system for guiding a web of media travelling from upstream to downstream along a transport path in an in-track direction, the web of media having a first side and an opposing second side, comprising:

a fixed web-guiding structure having a convex exterior surface, wherein a pattern of air holes are formed through the exterior surface;

an air source for providing an air flow through the air holes; and a web-guiding roller located in proximity to the web-guiding structure, the web-guiding roller being rotatable around a roller axis;

wherein the web of media travels around the web-guiding roller with the web of media contacting an exterior surface of the web-guiding roller through a wrap angle of less than 5 degrees, wherein the web of media travels around the fixed web-guiding structure through a wrap angle of more than 10 degrees, the air flow through the air holes lifting the web of media away from the web-guiding structure such that the first side of the web of media is substantially not in contact with the web-guiding structure;

wherein a distance along the transport path between the web-guiding roller and the fixed web-guiding structure is less than 10% of a cross-track width of the fixed web-guiding structure; and wherein the web-guiding roller has a width in the direction of the roller axis which is less than 20% of a cross-track width of the fixed web-guiding structure.

2. The web-guiding system of claim 1 wherein a distance that the web of media travels along the transport path between the web-guiding roller and the fixed web-guiding structure is less than two diameters of the web-guiding roller.

3. The web-guiding system of claim 1 wherein the web-guiding roller includes one or more grooves formed around the exterior surface of the web-guiding roller.

4. The web-guiding system of claim 3 further including a roller air source for providing an air flow into one or more of the grooves in a direction substantially parallel to the in-track direction of the receiver media and to the grooves, the air flow being directed between the web of media and the exterior surface of the web-guiding roller thereby producing a Bernoulli force to draw the web of media toward the exterior surface of the web-guiding roller thereby increasing a traction between the web of media and the web-guiding roller.

5. The web-guiding system of claim 1 wherein the web-guiding roller and the fixed web-guiding structure are both on the same side of the web of media such that the first side of the web of media contacts the exterior surface of the web-guiding roller.

6. The web-guiding system of claim 1 further including a tensioning mechanism that provides a force on the web-guiding roller to push it toward the web of media.

7. The web-guiding system of claim 1 wherein the web-guiding roller is mounted to the fixed web-guiding structure.

8. The web-guiding system of claim 1 wherein the web-guiding roller is a first web-guiding roller which rotates around a first roller axis, and further including a second web-guiding roller located in proximity to the web-guiding structure, the second web-guiding roller being rotatable around a second roller axis, wherein the web of media travels around the second web-guiding roller with the web of media contacting the second web-guiding roller through a wrap angle of less than 5 degrees.

9. The web-guiding system of claim 8 wherein the first and second web-guiding rollers and the fixed web-guiding structure are all on the same side of the web of media such that the first side of the web of media contacts the exterior surface of the first and second web-guiding rollers.

10. The web-guiding system of claim 8 wherein the first web-guiding roller is located upstream of the fixed web-guiding structure and the second web-guiding roller is located downstream of the fixed web-guiding structure.

11. The web-guiding system of claim 1 further including an air flow control mechanism for controlling which air holes the air flow is provided through in accordance with a width of the web of media.

12. The web-guiding system of claim 11 wherein the air flow control mechanism includes one or more fixed walls internal to the fixed web-guiding structure which define a plurality of air chambers with independently controllable air supplies.

13. The web-guiding system of claim 11 wherein the air flow control mechanism includes one or more moveable walls internal to the fixed web-guiding structure which define an internal air chamber corresponding to the air holes through which the air flow is provided.

14. The web-guiding system of claim 11 wherein the air flow control mechanism includes one or more louvers positioned internal to the fixed web-guiding structure which are repositionable to cover different sets of air holes, thereby blocking air flow through the covered air holes.

15. The web-guiding system of claim 1 wherein the fixed web-guiding structure is a turn-bar which is used to turn over the receiver media.

16. The web-guiding system of claim 15 wherein the turn-bar is oriented at an oblique angle relative to the initial in-track direction of the web of media.

17. The web-guiding system of claim 1 wherein the roller axis of the web-guiding roller is substantially perpendicular to the in-track direction of the receiver media at the location along the transport path where the web of media contacts the web-guiding roller.

18. The web-guiding system of claim 1 further including an air conditioning subsystem to condition the air provided by the air source.

19. The web-guiding system of claim 1 further including a roller control mechanism for adjusting an orientation of the roller axis relative to the in-track direction of the web of media, thereby providing a steering force on the web of media.

20. A web-guiding system for guiding a web of media travelling from upstream to downstream along a transport path in an in-track direction, the web of media having a first side and an opposing second side, comprising:

a fixed web-guiding structure having a convex exterior surface, wherein a pattern of air holes are formed through the exterior surface;

an air source for providing an air flow through the air holes;

a first web-guiding roller located in proximity to the web-guiding structure, the first web-guiding roller being rotatable around a first roller axis, wherein the web of media travels around the first web-guiding roller with the web of media contacting an exterior surface of the web-guiding roller through a wrap angle of less than 5 degrees; and a second web-guiding roller located in proximity to the web-guiding structure, the second web-guiding roller being rotatable around a second roller axis, wherein the web of media travels around the second web-guiding roller with the web of media contacting the second web guiding roller through a wrap angle of less than 5 degrees;

wherein the web of media travels around the fixed web-guiding structure through a wrap angle of more than 10 degrees, the air flow through the air holes lifting the web of media away from the web-guiding structure such that the first side of the web of media is substantially not in contact with the web-guiding structure;

wherein the first web-guiding roller is located upstream of the fixed web-guiding structure and the second web-guiding roller is located downstream of the fixed web-guiding structure; and wherein the first and second web-guiding rollers are recessed into the fixed web-guiding structure and are positioned to limit the air flow provided through the air holes from exiting a region between the fixed web-guiding structure and the web-of media in an upstream or downstream direction.

21. The web-guiding system of claim 20 wherein a gap between the fixed web-guiding structure and the first and second web-guiding rollers is less than 0.01 inches around at least 20% of the circumference of the first and second web-guiding rollers.

22. A web-guiding system for guiding a web of media travelling from upstream to downstream along a transport path in an in-track direction, the web of media having a first side and an opposing second side, comprising:

a fixed web-guiding structure having a convex exterior surface, wherein a pattern of air holes are formed through the exterior surface;

an air source for providing an air flow through the air holes; and a web-guiding roller located in proximity to the web-guiding structure, the web-guiding roller being rotatable around a roller axis;

wherein the web of media travels around the web-guiding roller with the web of media contacting an exterior surface of the web-guiding roller through a wrap angle of less than 5 degrees, and wherein the web of media travels around the fixed web-guiding structure through a wrap angle of more than 10 degrees, the air flow through the air holes lifting the web of media away from the web-guiding structure such that the first side of the web of media is substantially not in contact with the web-guiding structure; and wherein a portion of the exterior surface of the web-guiding roller protrudes through an opening in the fixed web-guiding structure.

23. The web-guiding system of claim 22 wherein the opening in the fixed web-guiding structure is centrally-located in a cross-track direction.

* * * * *